US010889401B2

(12) United States Patent
Lux et al.

(10) Patent No.: US 10,889,401 B2
(45) Date of Patent: Jan. 12, 2021

(54) LABEL APPLICATION SYSTEMS

(71) Applicant: ACTEGA North America Technologies, Inc., Delran, NJ (US)

(72) Inventors: Benjamin David Lux, Providence, RI (US); Jason A. Meek, Pawtucket, RI (US); Michael Medeiros, Plainville, MA (US); Michael Clarke Woods, Rumford, RI (US); Andrew W. Marsella, Providence, RI (US); Nikolai A. Voicechovski, Westerly, RI (US); Heidi M. Munnelly, Cumberland, RI (US); Juris Alex Grauds, Canton, MA (US)

(73) Assignee: ACTEGA North America Technologies, Inc., Cinnaminson, NJ (US)

( * ) Notice: Subject to any disclaimer, the term of this patent is extended or adjusted under 35 U.S.C. 154(b) by 0 days.

(21) Appl. No.: 15/958,661

(22) Filed: Apr. 20, 2018

(65) Prior Publication Data

US 2018/0346174 A1 Dec. 6, 2018

Related U.S. Application Data

(60) Provisional application No. 62/487,520, filed on Apr. 20, 2017.

(51) Int. Cl.
*B65C 9/18* (2006.01)
*B65C 3/14* (2006.01)
(Continued)

(52) U.S. Cl.
CPC ..... *B65C 9/1869* (2013.01); *B65C 3/14* (2013.01); *B65C 9/0006* (2013.01); *B65C 9/04* (2013.01);
(Continued)

(58) Field of Classification Search
CPC ..... B65C 9/1869; B65C 3/14; B65C 9/0006; B65C 9/04; B65C 9/1865; B65C 9/28;
(Continued)

(56) References Cited

U.S. PATENT DOCUMENTS 5,431,763 A 7/1995 Bradshaw
6,051,311 A * 4/2000 Osaka ..... B31D 1/021 428/202
(Continued)

FOREIGN PATENT DOCUMENTS

DE 36 38 511 A1 5/1988
DE 200 06 315 U1 10/2000
(Continued)

OTHER PUBLICATIONS

Translation of WO-2012086254-A1, Jun. 2012, WO, Nakamura Hiroshi (Year: 2012).*
(Continued)

*Primary Examiner* — George R Koch
(74) *Attorney, Agent, or Firm* — Wolf, Greenfield & Sacks, P.C.

(57) ABSTRACT

Systems and methods for applying decorations from a web onto a substrates are disclosed. According to some aspects, a decoration may be transferred from the web directly to a substrate based on contact of the substrate with an adhesive of a portion of the decoration while the portion of the decoration is attached to the web.

23 Claims, 29 Drawing Sheets

(51) Int. Cl.
*B65C 9/00* (2006.01)
*B65C 9/04* (2006.01)
*B65C 9/28* (2006.01)

(52) U.S. Cl.
CPC ..... *B65C 9/1865* (2013.01); *B65C 9/1892* (2013.01); *B65C 9/28* (2013.01)

(58) Field of Classification Search
CPC ..... B65C 9/40; B65C 9/42; B65C 9/1873; B65C 3/16
USPC ..... 156/352, 368, DIG. 44
See application file for complete search history.

(56) References Cited

U.S. PATENT DOCUMENTS

2008/0047660 A1* 2/2008 Angel ..... B65C 9/1869 156/238
2010/0326581 A1* 12/2010 Roseman ..... B65C 9/1865 156/60

FOREIGN PATENT DOCUMENTS

WO WO 2009/136138 A1 11/2009
WO WO-2012086254 A1 * 6/2012 ..... B65C 9/1865

OTHER PUBLICATIONS

Invitation to Pay Additional Fees for International Application No. PCT/US2018/028631, mailed Aug. 16, 2018.
International Search Report and Written Opinion for International Application No. PCT/US2018/028631 dated Nov. 29, 2018.
International Preliminary Report on Patentability for International Application No. PCT/US2018/028631, dated Oct. 31, 2019.

* cited by examiner

LABEL APPLICATION SYSTEMS

RELATED APPLICATION

This Application claims priority under 35 U.S.C. § 119(e) to U.S. Provisional Application Ser. No. 62/487,520, entitled "LABEL APPLICATION SYSTEMS" filed Apr. 20, 2017, which is herein incorporated by reference in its entirety.

BACKGROUND

Adhesive labels are widely used, such as for providing information and/or decoration on substrates such as bottles and other containers, on packages for shipment, on products for sale, and so on. In some applications, labels are provided on a continuous web, which may be rolled onto a spool. During a labeling process, the web is unwound from the spool guided through a pre-defined path to a location at which the labels are removed from the web and applied to the substrate. Frequently, such webs are controlled by features such as rollers which contact the front and back surfaces of the web to guide the web, maintain a desired web tension, and otherwise control the positioning and/or velocity of the web such that the labels may be accurately positioned when applied to the substrate.

The labels typically have an adhesive side, whether formed by a pressure-sensitive adhesive (PSA), a glue applied to the label or a thermally-activated or fluid-activated adhesive, that serves to secure the label to a box, product or other substrate. When the label is applied to the substrate, the adhesive side may be exposed, e.g., by peeling the label off of the web or by removing a liner from the adhesive side. In certain applications, the adhesive side may be non-tacky until just prior to applying the label, at which time the adhesive is activated (e.g., by applying heat or an activation fluid) and the label is applied to the substrate.

SUMMARY

Aspects described herein relate to systems and methods for applying decorations (e.g. labels) from a continuous web onto substrates. The web may include a carrier film with a plurality of decorations provided on one side of the carrier film (e.g., a front side of the web.). The decorations may have a tacky adhesive layer, such as a pressure sensitive adhesive (PSA) layer or other suitable viscoelastic adhesive layer, provided on a side of the decoration opposite the carrier film for adhering the decorations to the substrates. Accordingly, the tacky adhesive layer may be exposed one side of the web (i.e., the side of the web on which the decorations are provided). However, the inventors have appreciated that when using such decorations, conventional web control systems may not be suitable, as contact between the adhesive layer and rollers or other components of a web control system may damage the decoration or web and/or foul the web control system. Similarly, in some applications, a web may include decorations having small and/or delicate portions (e.g., decorative elements), and thus it may be desirable to avoid contacting those portions of the decorations while controlling or guiding the web prior to application of the decorations onto the substrates.

Depending on the embodiment, each decoration on a web may include a single element that may be transferred to a substrate, or each decoration can include multiple elements that are separate from each other though initially supported on a common web and transferred to the same substrate. In some instances, the term "label" may be used to refer to a decoration; accordingly, as used herein, the terms "decoration" and "label" have the same meaning and may be used interchangeably. Thus, in some cases, a label may include a single element or multiple elements that are transferred together to substrate.

Moreover, it should be understood that the term decoration does not necessarily refer to "decorating" an item in any particular aesthetic sense. For example, a decoration may provide visible graphics, text, colors, optical effects (like diffraction that gives a rainbow effect), and so on.

In one embodiment, a system for transferring decorations to substrates may include a continuous web including a plurality of decorations provided on a first side of the web, with each decoration having a pressure sensitive adhesive exposed on a surface of the decoration facing outwardly from the first side of the web. The system may include an application station at which the decorations are transferred from the web to substrates, a web path along which the web travels to transport the decorations to the application station, and a substrate transport configured to move the substrates to the label application station, and a web control system including at least one web controller configured to move the web at the application station to position a decoration on the web for transfer to a substrate. Moreover, the application station may be configured to transfer a decoration from the web directly to a substrate based on contact of the substrate with the pressure sensitive adhesive of a portion of the decoration while the portion of the decoration is attached to the web.

It should be understood that transfer of a decoration from a web to a substrate may be accomplished via any number of suitable mechanisms, and that the current disclosure is not limited to any particular mechanism. For example, in some instances, contact between an adhesive surface of a decoration and a substrate may cause the decoration to adhere to the substrate and release or separate from the web, thereby resulting in the decoration being transferred directly to the substrate from the web.

As noted above, in some instances, a decoration or label may include multiple separate elements or decoration components. These decoration components may be physically separated from one another on the web, and the decoration components may be transferred together onto a substrate in register with one another, thereby maintaining the relative spacing and arrangement and orientation of the decoration components after being transferred to the substrate. The decoration components may work together to form a single decoration. For example, the decoration components may comprise different graphical elements that work together to form the decoration. In some instances, separate decoration components may include text characters that form a word, phrase, number, and so on.

According to some aspects, systems and methods described herein may be used to apply decorations and/or labels to substrates. In some instances, applying a decoration to a substrate may involve directly transferring the decoration to the substrate from the web. In such embodiments, the decoration is always supported by either the web. In other instances, a decoration may be partially or completely separated from the web prior to being applied to the substrate.

In one embodiment, a method for applying a decoration to a substrate includes moving a continuous web along a web path to transport a plurality of decorations provided on a first side of the web to an application station. Each decoration comprises two or more physically separate decoration components and each decoration component has an adhesive exposed on a surface of the decoration component facing outwardly from the first side of the web. The method further includes applying the two or more decoration components in register with one another onto the surface of a substrate at the application station.

In another embodiment, a system for applying decorations to substrates may include a continuous web including a plurality of decorations provided on a first side of the web, with each decoration having an adhesive exposed on a surface of the decoration facing outwardly from the first side of the web. The system may further include an application station at which the decorations are applied from the web to substrates, a web path along which the web travels to transport the decorations to the application station, a substrate transport configured to move the substrates through the application station, and a web control system including at least one web controller. The web control system may be configured to move the web at the application station along a direction of travel of the substrates through the application station.

In yet another embodiment, a method for applying a decoration to a substrate includes moving a continuous web along a web path to transport a plurality of decorations provided on a first side of the web to an application station. Each decoration has an adhesive exposed on a surface of the decoration facing outwardly from the first side of the web. The method further comprises moving a substrate through the application station to apply a decoration to the substrate and moving the web at the application station along a direction of travel of the substrate through the label application station.

According to some aspects, relative movement of a decoration on a web and a substrate may be controlled, such as, during application of the decoration to the substrate. For example, such relative motion between the decoration and the substrate may aid in releasing the decoration from the web when transferring a decoration from the web to a substrate.

In one embodiment, system for applying decorations to substrates includes a continuous web including a plurality of decorations provided on a first side of the web, with each decoration having an adhesive exposed on a surface of the decoration facing outwardly from the first side of the web. The system further includes an application station at which the decorations are applied from the web to substrates, a web path along which the web travels to transport the decorations to the application station, and a web control system including at least one web controller. The web control system is configured to stop movement of the web when a decoration is positioned at the application station. The system further includes a substrate transport configured to move a substrate through the application station while the web is stopped to move the substrate relative to the decoration positioned at the application station and apply the decoration to the substrate.

In another embodiment, a method for applying a decoration to a substrate includes moving a continuous web along a web path to transport a plurality of decorations provided on a first side of the web to an application station. Each decoration has an adhesive exposed on a surface of the decoration facing outwardly from the first side of the web. The method further includes stopping movement of the web when a decoration is positioned at the application station, and moving a substrate through the application station while the web is stopped to apply the decoration positioned at the application station to the substrate.

According to some aspects, decorations provided on a web may have an exposed adhesive surface, and as noted previously, the inventors have appreciated that conventional web control systems may not be suitable, as contact between the exposed adhesive and rollers or other components of a web control system may damage the decoration or web and/or foul the web control system.

In one embodiment, a system for applying labels to substrates may include an application station at which decorations are applied to substrates from a web. The web may include a first side and a second side opposite the first side, and the decorations may be provided on the first side. The system may include a web path along which the web travels to transport the decorations to the application station, and the web path may include a first path portion positioned before the application station and a second path portion positioned after the application station. A web control system including at least one web controller may be provided, and the web control system may be configured to control at least one web characteristic without physically contacting at least a portion of the first side of the web and the decorations along the first path portion.

For example, the decorations may be carried on the web through the first path portion and to the application station where the decorations are applied to the substrate, and when in the second path portion, the web may be devoid of decorations. In some embodiments, the system may be arranged to control the web characteristics without physically contacting the portions of the web where an adhesive surface of the decorations is exposed as the decorations are transported through the first web path portion. The web characteristics may include, without limitation, a web tension, a direction of travel of the web, a velocity of the web, a position of the web, and an alignment of the web, and controlling one or more of these web characteristics may allow for accurate application of the labels onto the substrate.

In some embodiments, the web control system may include at least one web controller to control the one or more web characteristics in the first path portion without physically contacting one side of the web (e.g., a front side on which the decorations are provided). Along the second path portion, additional web controllers (e.g., rollers, idlers, brakes, and the like) may be provided which may contact the entire web, including both the front and back sides of the web, to control and/or guide the web as desired.

The web control system described herein may include any number of sensors, detectors, controllers, relays, etc., arranged to detect and/or control any number of web characteristics. For example, sensors may be provided to determine the web tension, the web velocity, the direction of the web, an angular alignment of the web, a position of the web along a direction transverse to the web path, and so on. One or more controllers may be provided to adjust the web (e.g., the web tension, velocity, direction, position, etc.) based on the sensed web characteristics. In some cases, sensors and/or controllers may be provided at multiple locations along the web path to control the web as desired.

In some embodiments, the web control system may include one or more web controllers arranged to apply a force to one side of the web without physically contacting the web. Such web control elements may be employed to control the web characteristics (e.g., to guide the web along a desired direction, to control the web tension, etc.). In one embodiment, a non-contact guide may be provided along the first path portion and may employ pressurized air to apply a force against the front side of the web, thereby allowing for non-contact web guidance and/or tension control along the first path portion. In another embodiment, a vacuum belt may be provided along the first path portion and arranged to apply vacuum to the back side of the label. In this manner, the vacuum belt may guide and/or control the web without contacting the front surface of the web.

In some embodiments, one or more web controllers may be configured to contact the front side of web at positions where the decorations are not provided. For example, the decorations may be located only in a central portion of the web and spaced from the top and bottom edges of the web, and one or more rollers may be arranged to contact the front side of the web only along top and/or bottom portions of the web adjacent the edges of the web. In some embodiments, one or more web controllers may be arranged to contact the front side of the web at spaces between decorations on the web.

In another embodiment, a method for applying a decoration to a substrate includes transporting a decoration along a web path to an application station. The decoration is provided on a first side of a web opposite a second side of the web, and the web path includes a first path portion positioned before the application station and a second path portion positioned after the application station. The method further includes controlling at least one web characteristic without physically contacting at least a portion of the first side of the web and the decorations along the first path portion, and applying the label to a substrate at the application station.

According to some aspects, an application station may include one or more features to assist with applying a decoration from a web to a substrate. For instance, in some systems, an adhering force between the decorations and the web may be similar in strength to an adhering force between the adhesive layer of the decorations and the substrate. Therefore, it may be advantageous to assist with releasing the decorations from the web at the application station to ensure proper application of the decoration to the substrate.

In some embodiments, an actuator may be provided at the application station to forcibly press the decorations into contact with the substrate, which may increase the adhesion force between the adhesive layer of the decoration and the substrate. For example, in some embodiments, an actuator may be provided to press the substrate against the decoration (and against the web) as the decoration is moved through the application station. The actuator may be configured to provide an application force to any suitable portion of the decoration, including, but not limited to, a central portion of the decoration or an edge of the label. Alternatively, or in addition, in some embodiments, an actuator may be provided to apply an application force to the web to press the web (and the decoration) against the substrate. In some embodiments, the web may be perforated or gas permeable, and a pressurized gas (e.g., pressurized air) may be applied through the web to apply a force to the decorations to assist with separating the decorations from the web and applying the decorations to the substrates.

In some embodiments, the application station may include one or more features to assist with physically separating labels from a web prior to application onto the substrate. For example, a label separator may be provided to at an entrance to the application station and arranged to apply a force to an interface between the labels and the web. In one embodiment, the separator may include a wire or other suitable structure positioned at the interface of the labels and the web. In another embodiment, a label separator may apply a force to the interface without physically contacting the interface. For instance, the separator may employ pressurized air to apply a separating force to the label-web interface.

In some embodiments, labels may include an activatable release layer provided between a web and the labels. At the application station, the release layer may be activated (e.g., by application of heat, radiation such as UV light, an activation fluid, etc.) to aid in release of the label from the web.

In some embodiments, the application system may include one or more features to enhance an attractive force between the labels and the substrates to assist with application of the labels. For example, in one embodiment, the substrates may be treated prior to entering the label application station. The treatment may include, without limitation, a thermal treatment, exposure to radiation (e.g., UV light), and/or application of a fluid to enhance label application at the label application station. In another embodiment, the labels and/or substrates may be electrostatically charged prior to passing through the label application station to create an electrostatic attraction between the labels and the substrates to further assist with application of the label.

According to some aspects, a label application system may employ a temporary liner to protect the front side of the web (including the decorations provided thereon) as the web is guided through at least a portion of the first web path portion prior to label application. The temporary liner may be configured to easily release from the front side of the web, and the temporary liner may be provided along the portion of the first web path portion to allow for control of the web as desired. In particular, one or more web controllers may be provided to apply a force to the front side of the web through the temporary liner, and therefore the web controllers may control one or more characteristics of the web while not directly contacting the front side of the web. Thereafter, and prior to application of the decorations, the temporary liner may be removed from the front side of the web.

In one embodiment, a system for applying decorations to substrates includes an application station at which decorations are applied to a substrate from a web. The web includes a first side and a second side opposite the first side, and the decorations are provided on the first side. The system further includes a web path along which the web travels to transport the decorations from a to the application station, and the web path includes a first path portion positioned before the application station and a second path portion positioned after the label application station. A liner is arranged to contact the first side of the web only along a contact length of the of the first web path portion, and the contact length is shorter than a total path length of the first web path portion.

In another embodiment, a method for applying a decoration to a substrate includes transporting a decoration along a web path to an application station. The decoration is provided on a first side of a web opposite a second side of the web, and the web path includes a first path portion positioned before the label application station and a second path portion positioned after the label application station. The method further includes moving a liner into contact with the first side of the web only along a contact length of the first web path portion. The contact length is shorter than a length of the first web path portion. The decoration is applied to a substrate at the application station.

In some embodiments, the liner may be provided on a liner supply reel and may be transported along a liner path to a liner take-up reel. The liner may be arranged to contact the first side of the web along a portion of the liner path to define the contact length of the first web path portion.

In some embodiments, the liner may be provided as a continuous closed loop defining a liner loop path, and the liner may be arranged to contact the first side of the web along a portion of the liner loop path to define the contact length of the first web path portion.

In some embodiments, a portion of the web in the second web path portion may be used as the liner. For example, after the label is removed from the web and applied to the substrate, the web in the second web path portion may be configured to contact the front side of the web in the first path portion to define the contact length of the first path portion.

According to some aspects, a decoration application system may be arranged to maintain contact between decorations on a web and the substrates over an extended contact length prior to final application of the decorations to the substrates. For example, such arrangements may provide for an increased contact time between the decorations and the substrates during decoration application, which may promote the adhesion between the decorations and the substrates. In some cases, such increased adhesion may aid in releasing the decorations from the web during application and/or may improve the quality of the decoration application.

In one embodiment, a system for applying decorations to substrates may include an application station at which decorations are applied to substrates from a web. The web may include a first side and a second side opposite the first side, and the decorations may be provided on the first side. The system may include a web path along which the web travels to transport the decorations to the application station, and a web control system including at least one web controller may be provided to control at least one web characteristic. The decorations and the substrates may be held in contact along an extended contact length at the label application station before the decorations are applied to the substrates.

Other features and advantages are apparent from the following description and from the claims.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
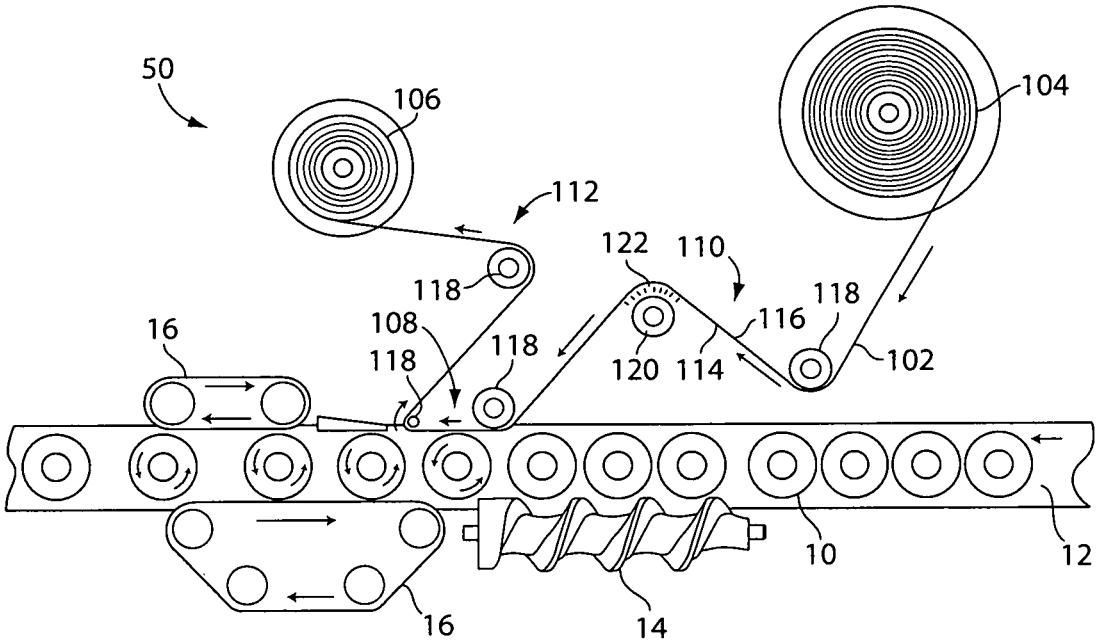
FIG. 1 is a top view of a label application system including an air roller, according to one embodiment.

It should be understood that aspects of the invention are described herein with reference to the figures, which show illustrative embodiments. The illustrative embodiments described herein are not necessarily intended to show all embodiments in accordance with the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

In some embodiments, a web may include a plurality of labels provided on a first side of the web opposite a second side of the web. Each label may include an adhesive layer (such as a layer of a PSA), and the adhesive layer may be exposed on the first side of the web. In some embodiments, the web may be a carrier film, and the labels may be provided on and/or formed on the carrier film using a suitable printing or other method. For example, the labels may include a first label layer formed on the carrier film, and the first label layer may form the outer surface of the label when the label is applied to a substrate. One or more indicia layers may be provided on the first label layer, followed by an adhesive layer formed on the indicia layer(s). In this manner, the labels may be reverse printed and may feature an exposed adhesive layer which may be located between the substrate and the indicia and first label layers when the label is applied to the substrate. In some cases, the carrier film and the labels provided thereon may be rolled prior to application. In such cases, the adhesive layer and the carrier film may be configured such that the adhesive layer does not adhere strongly to the adhesive layer so that the carrier film web may be easily unrolled during application without disturbing the labels. In some instances, a release layer may be provided between the carrier film and the first label layer to facilitate release of the labels from the carrier film. For example, labels and webs which may be used with the systems provided herein are described in US Patent Application Pub. No. 2016/0335927. However, it should be understood that the current disclosure is not limited to any particular types of labels or web arrangements.

Depending on the particular embodiment, the labels may bear any suitable visible or non-visible information, such as text, graphics, electronic circuitry (such as an RFID device), etc. Moreover, a label may be provided as a single, continuous piece of material applied to a substrate, or alternatively, the label may be formed as a plurality of separate label components which collectively form the label. Additionally, it should be understood that the systems described herein may be suitable for applying labels to any suitable substrates, such as bottles or other containers (including irregularly shaped containers), boxes, envelopes, or other packaging materials, products for sale, etc.

FIG. 1 depicts an illustrative embodiment of a label application system 50 for applying a label to substrates, such as bottles 10, from a web 102. The bottles 10 may be transported to an application station 108 where the labels are applied to the bottles. In some instances, the labels may be transferred directly from the web 102 to the substrates at the application station 108, such that the labels are always supported by either the web or the substrate.

The bottles (or other suitable substrates) may be provided on a substrate transport such as a belt 12 to move the bottles towards and through the application station 108. As illustrated, the web 102 may move along a direction of travel of the bottles through the application station 108, e.g., along the same direction as the direction of travel of the belt 12. Although a linear belt is depicted, other configurations are contemplated, such as rotary labeling systems which transport bottles along a generally circular path. In some embodiments, a timing screw 14 may be used to achieve a desired spacing of the bottles 10 along the belt 12. While a screw 14 is shown in the figures, it should be understood that other arrangements may be suitable to control a rate at which bottles (or other substrates) move to and through the application station.

Additionally, one or more belts 16 may be provided to contact sides of the bottles while the bottles are moved though the label applications station, and/or before or after the bottles arrive at the label application station. In some cases, the belt(s) 16 may be driven by an associated drive (not depicted), and the belt(s) may impart a desired rotation to the bottles before, during, and/or after the bottles are labeled. Alternatively, the belts may not be driven and may be stationary, or the belt(s) may be provided on freely rotating rollers or bearings. Accordingly, it should be understood that the label application systems described herein are not limited to any particular arrangements for transporting bottles or other substrates to be labeled.

The web 102 may be provided as a web roll 104, and the web may be guided along a web path through the application system 50 to a web take-up roll 106. The application system may use the web to transport the labels to the label application station 108, where the labels are applied to the bottles 10. The web path includes a first web path portion 110 along which the web is guided from the roll 104 to the label application station 108, and a second web path portion 112 along which the web is guided from the label application station to the web take-up reel 106.

The web 102 includes a first side 114 and a second side 116 opposite the first side. A plurality of labels (not depicted) may be provided on the first side and the labels may be transported on the web to the label application station 108 for application to the bottles 10. As discussed previously, the labels may include an adhesive layer that is exposed on the first side 114 of the web. At the label application station 108, the adhesive layer of the labels may be brought into contact with bottles 10, and the adhesion between the adhesive layer and the bottles may cause the labels to release from the web 102 and stick to the bottles. For example, the adhesive force between the adhesive layer and the bottles 10 may be tuned to be larger than an adhesive force between the labels and the web, thereby allowing the contact with the bottles to pull the labels off of the web.

The label application system 50 may include a web control system arranged to control one or more characteristics of the web. For example the web control system may include one or more web controllers 118 arranged to contact the second side 116 of the web 102 along the first web path portion 110. Along the second web path portion 112 (i.e., after the labels have been applied to the containers 110), the web controllers 118 may be arranged to contact both the first and second sides 114, 116 of the web 102.

Depending on the particular embodiment, the web control system may include web controllers such as rollers (e.g., drive, idle, or tension rollers), or other web control features such as web guides as are known in the art for controlling various aspects or characteristics of the web 102. These characteristics may include a direction or velocity of the web, a web tension, a web alignment, and/or a position of the web along a direction transverse to a direction along which the web travels (e.g., to adjust the vertical alignment of the web and labels relative to the bottles). As noted previously, the web control system may include one or more sensors (not depicted), such as web tension sensors, web velocity sensors, web position sensors, etc., to detect the web characteristics. Moreover, the system may include any suitable number and/or arrangement of web controllers and/or sensors to guide and/or control a web as desired (e.g., to define a desired web path) as the current disclosure is not limited in this regard.

In some embodiments, the web control system may control movement of the web 102 through the application station 108. For example, the web control system may be configured to sop movement of the web when a label (or other suitable decoration) is positioned at the application station. While the web is stopped, the movement of the bottles along the belt 12 may impart relative motion between the label positioned at the application station and a bottle moving through the application station. The bottle and label may be brought into contact at the application station, and this relative movement may result in the label being applied to the bottle, (e.g., by transferring directly from the web to the substrate). After application of the label from the web to the bottle, the web controller may subsequently move the web to move another label to the application station.

In some applications, it may be desirable to provide additional web control along the first web path portion 110. However, since the labels are provided on the first side 114 of the web 102 along the first path portion, it may be desirable to avoid contact with the first side of the web (e.g., to avoid contacting an exposed adhesive layer of the labels). In the illustrative embodiment of FIGS. 1-2, the web control system includes a non-contact guide 120 arranged to apply pressurized air 122 to the first side 116 of the web. In this manner, the non-contact guide may act as an additional web controller (similar to the web controllers 118) and may use the pressurized air to apply a force to the first side of the web for controlling and/or guiding the web, as desired, without physically contacting the first side of the web. While a single non-contact guide 120 has been depicted, it should be appreciated that any suitable number of non-contact guides may be provided as desired for controlling the web 102 along the first web path portion 110.

Figure 2:
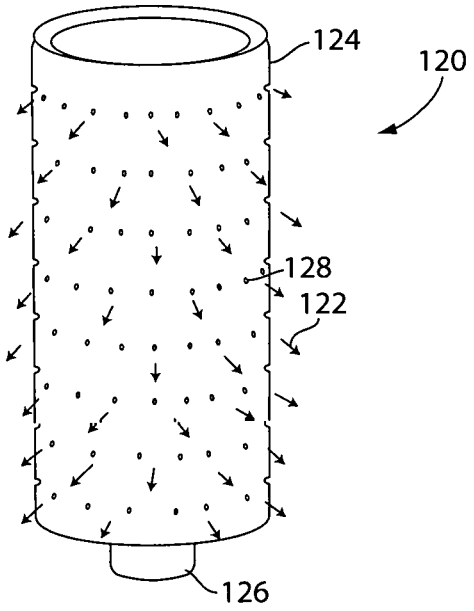
FIG. 2 is a perspective view of the air roller of FIG. 1.

FIG. 2 depicts a perspective view of the non-contact guide 120 of FIG. 1. As illustrated, the non-contact guide includes a generally cylindrically body 124 provided on a shaft 126. In some embodiments. the non-contact guide may be rotatable relative to the web 102. For example, in some embodiments the body may be rotatable relative to the shaft 124, or alternatively, the body may be fixed relative to the shaft and the shaft may be rotatably mounted in the application system 50. In other embodiments, though, the non-contact guide 120 may not be rotatable relative to the web, as the disclosure is not limited in this regard. The non-contact guide may be coupled to a pressurized air source (not depicted), and the pressurized air 122 may exit the non-contact guide through a plurality of apertures 128 formed in the body 124. Although a uniform array of apertures is depicted in FIG. 2, it should be understood that the non-contact guide may include any suitable arrangement of apertures to deliver airflow 122.

In some embodiments, airflow through the apertures 128 may adjustable and may be controlled to apply a desired force to the web 102 for controlling the web along the first web path portion 110. For instance, a controller (not depicted) may be provided and coupled to the non-contact guide and one or more sensors which may detect various web characteristics (e.g., web tension, web position, velocity, etc.); the controller may adjust the airflow from the non-contact guide to control the web as desired. Alternatively, the airflow may not be adjustable or controllable, and the airflow may be determined by the air pressure and the size, number, and arrangement of apertures 128.

While a non-contact guide 120 is described above in connection with FIG. 1, other arrangements in which contact may occur between the guide roller and the first side of the web may be suitable. For example in some embodiments, the guide 120 may include a coating selected such that the exposed adhesive of the labels/decorations does not adhere to the guide roller. In other embodiments, the guide 120 may be cooled or chilled to reduce adhesion between the guide roller and the exposed adhesive of the decorations.

As will be appreciated in view of the Figures, the various features described above in connection with FIG. 1, including the bottles 10, belt 12, timing screw 14, belt(s) 16, web 102, web roll 104, web take-up roll 106, label application station 108, first and second web path portions 110 and 112, first and second sides of the web 114 and 116, and web controllers 118 may be seen in embodiments depicted in FIGS. 3-28. It should be understood that these features may be arranged in any number of ways as would be apparent to one of skill in the art.

Figure 3:
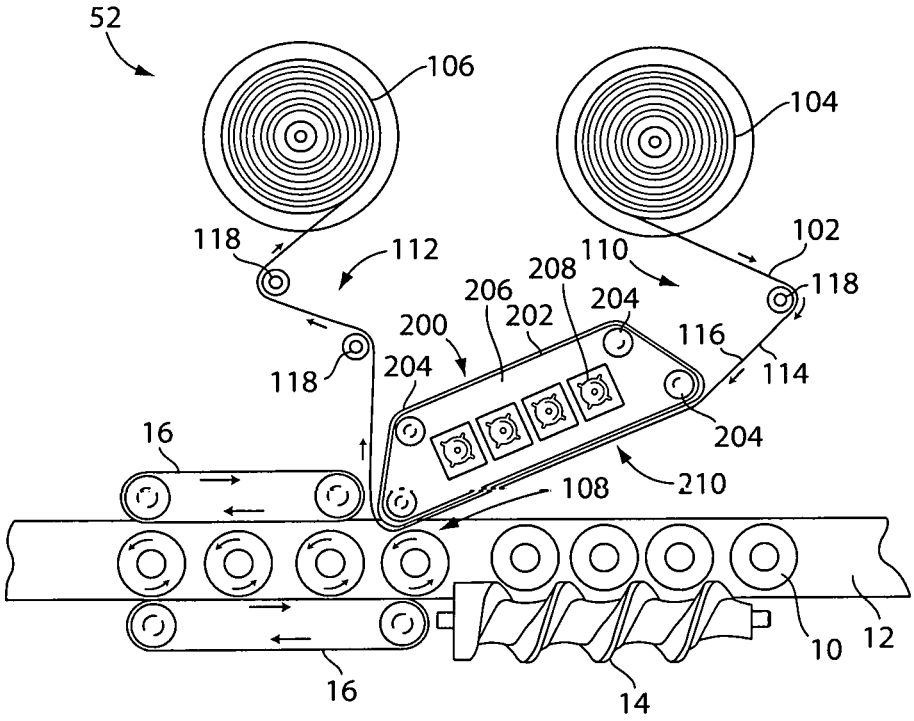
FIG. 3 is a top view of a label application system including a vacuum belt, according to one embodiment.

FIG. 3 depicts an illustrative embodiment of a label application system 52 including a vacuum belt system 200 for controlling and/or guiding the web 102 along the first web path portion 110 without contacting the first side 114 of the web. As illustrated, the vacuum belt system may include a belt 202 extending around a plurality of rollers 204 provided on a housing 206. A vacuum may be created within the housing, e.g., via a plurality of fans 208 arranged to blow air out of the housing. The housing 206 and belt 202 may include perforations arranged to communicate vacuum to a contact length 210 of the vacuum belt system. In this manner, the vacuum may pull the second side 116 of the web 102 against the vacuum belt along the contact length to facilitate web control and/or guidance. For example, in some applications, the rollers 204 may be arranged to drive the vacuum belt 202 at a different velocity than a velocity of the web, thereby providing control of the web tension and/or web velocity as the labels are transported through the label application station 108. In some embodiments, the vacuum belt system 200 may be movable relative to the web 102 to allow for a vertical adjustment of the web relative to the bottle (i.e., an adjustment to the web along a direction transverse to the direction of the web along the web path.

Figure 4:
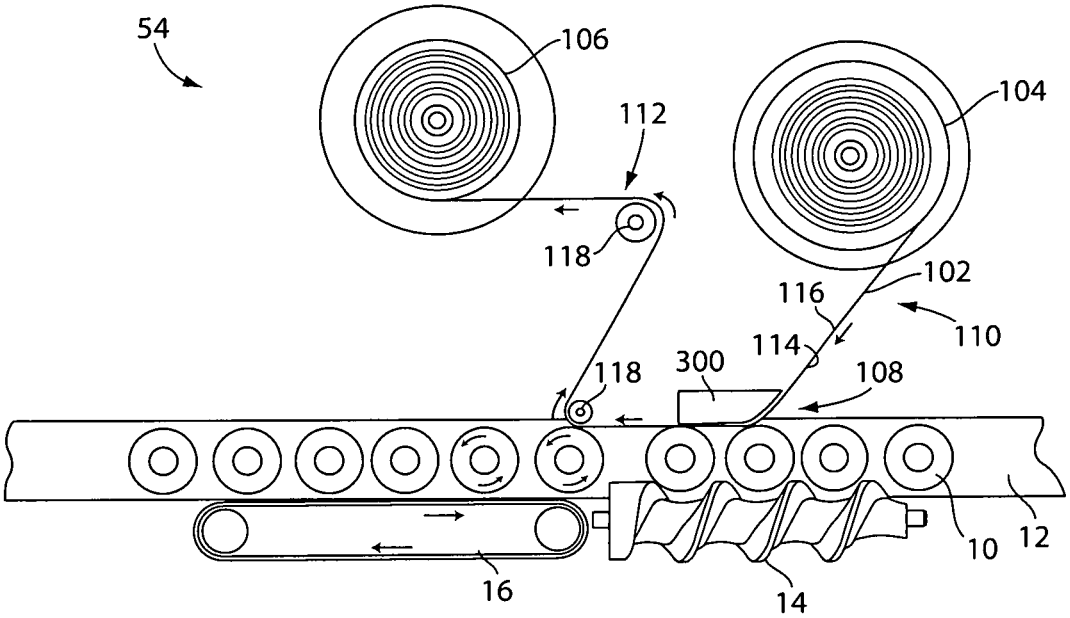
FIG. 4 is a top view of a label application system in which labels are applied directly after unwinding a web from a roll, according to one embodiment.

In some embodiments, web control may not be required prior to application of the labels to a substrate. For example, as depicted in FIG. 4, a label application system 54 may be arranged to apply labels from the web 102 the bottles immediately after unwinding the labels from the web roll 104, and web control may be accommodated by one or more web controllers 118 provided only along the second web path portion 112. Accordingly, the labels may be transported on the web directly from the web roll to the label application station 108. As illustrated, the label application station may include an applicator pad 300 arranged to contact the second side 116 of the web at the label application station. The applicator pad may be shaped and/or structured to apply a desired application force against the bottles as the web and bottles are moved through the label application station 108.

Figure 5:
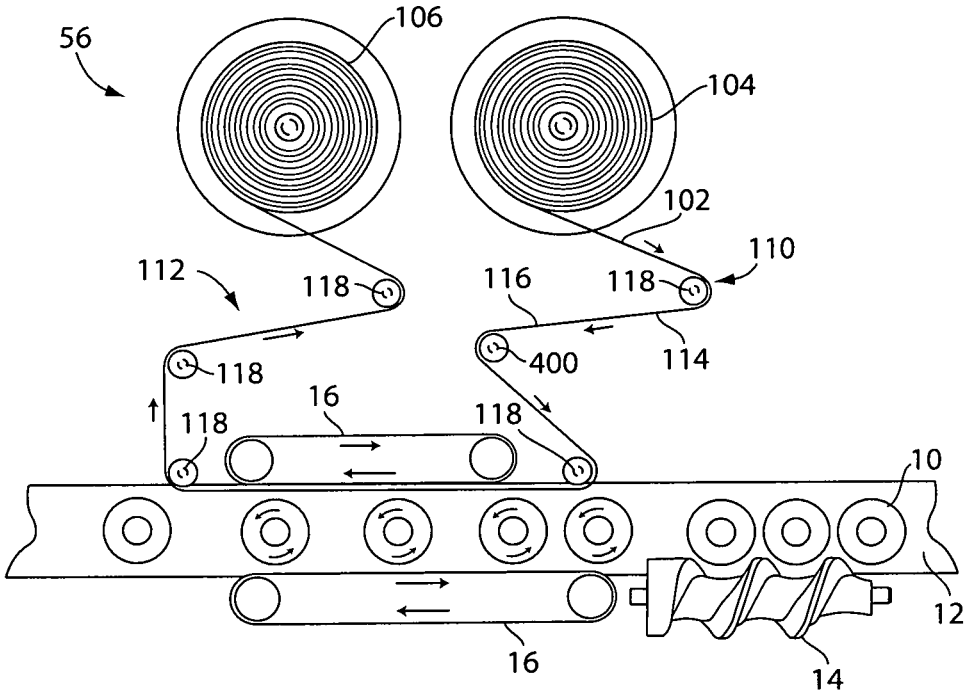
FIG. 5 is a top view of a label application system including a roller which contacts only a portion of a web, according to one embodiment.
Figure 6:
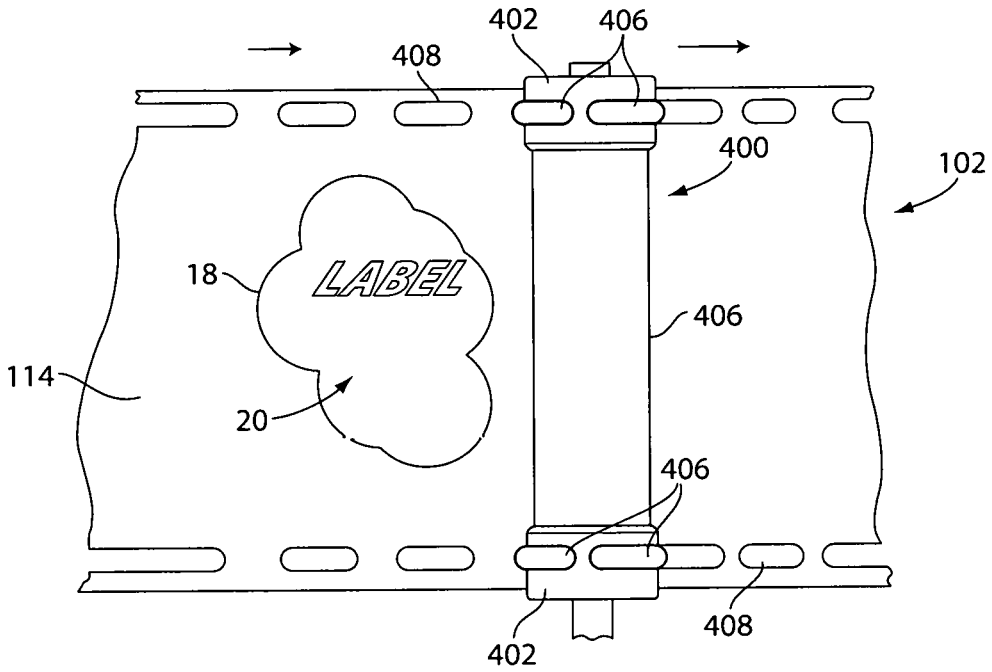
FIG. 6 is a front view of the roller and web of the FIG. 5 embodiment.

In some embodiments, a label application system may include one or more web control controllers along the first web path portion 110 which are configured to contact only a portion of the first side 114 of the web 102. For example, FIGS. 5-8 depict illustrative embodiments in which web controllers are configured to contact portions of the first side 114 of the web where the labels are not provided. In particular, FIGS. 5-6 depict an embodiment of a label application system 56 including a contoured web control roller 400 arranged to contact only the top and bottom edges of the first side 114 of the web. As illustrated, a label 18 is provided on the first side of the web, and is provided only in a central portion of the web, spaced from the edges of the web. The roller 400 is generally cylindrical in shape and includes end portions 402 which have a larger diameter than a central portion 404. Accordingly, the roller may contact the front side 114 of the web along the end portions, but the roller may be spaced from the front side along the central portion 404. In this manner, contact between the label 18 (including an adhesive surface 20 of the label) and the roller may be avoided while the roller controls the web as desired. In some embodiments, protrusions 406 may be provided on the end portions 402 and arranged to engage with corresponding openings 408 formed in the web 102. The protrusions and openings may provide a registration between the roller 400 and the web 102 to assist with web control and/or guidance, including driving the web. However, it should be understood that the protrusions and openings may not be provided in some embodiments, and that the roller may still suitably control or guide the web. For instance, in one embodiment the end portions 402 may include a rubber or other suitable material to increase friction at the interface between the end portions and the web.

Figure 7:
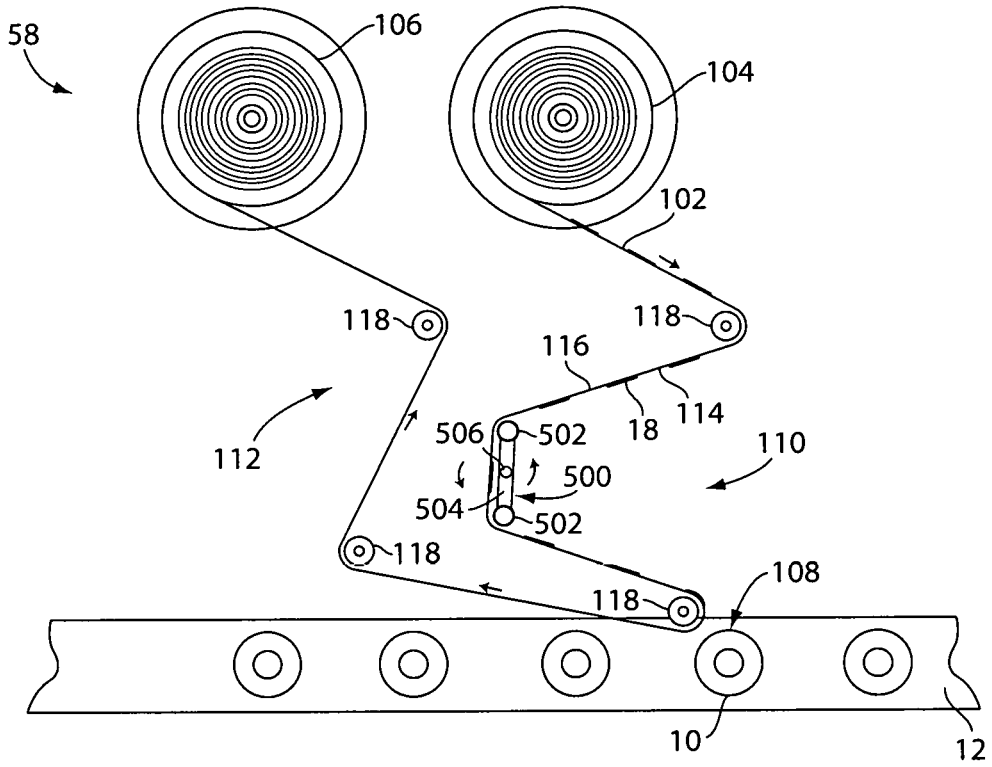
FIG. 7 is a top view of a label application system including a web controller which contacts only a portion of the web with the web controller in a first position, according to one embodiment.
Figure 8:
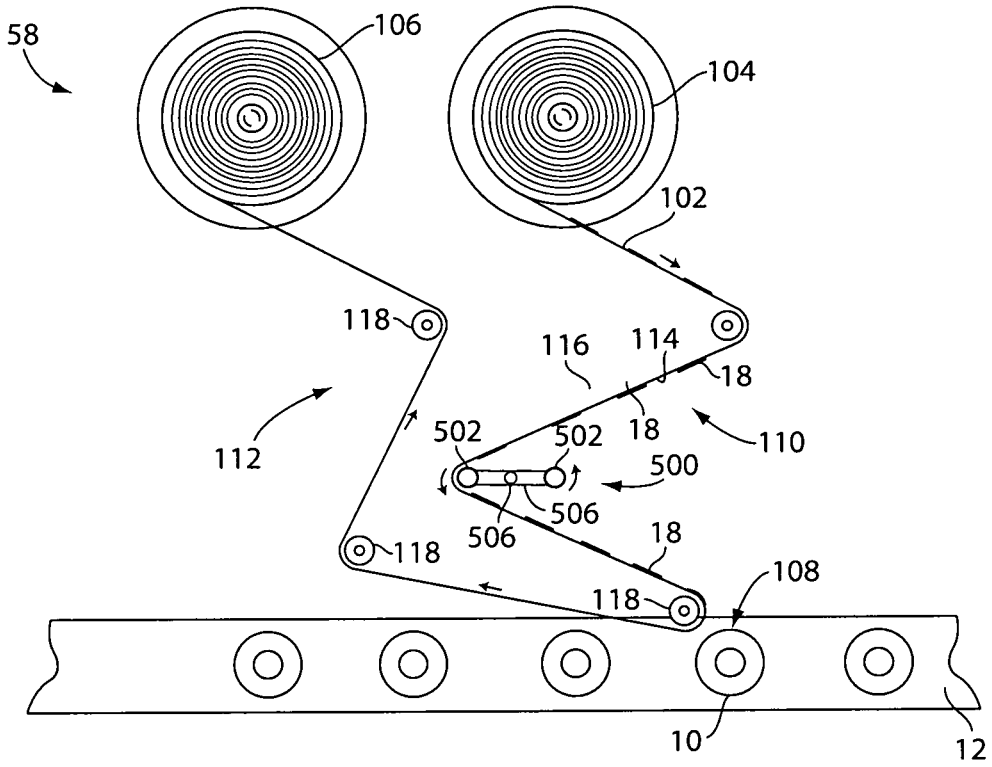
FIG. 8 is a top view of the label application system of FIG. 7 with the web controller in a second position.
Figure 9:
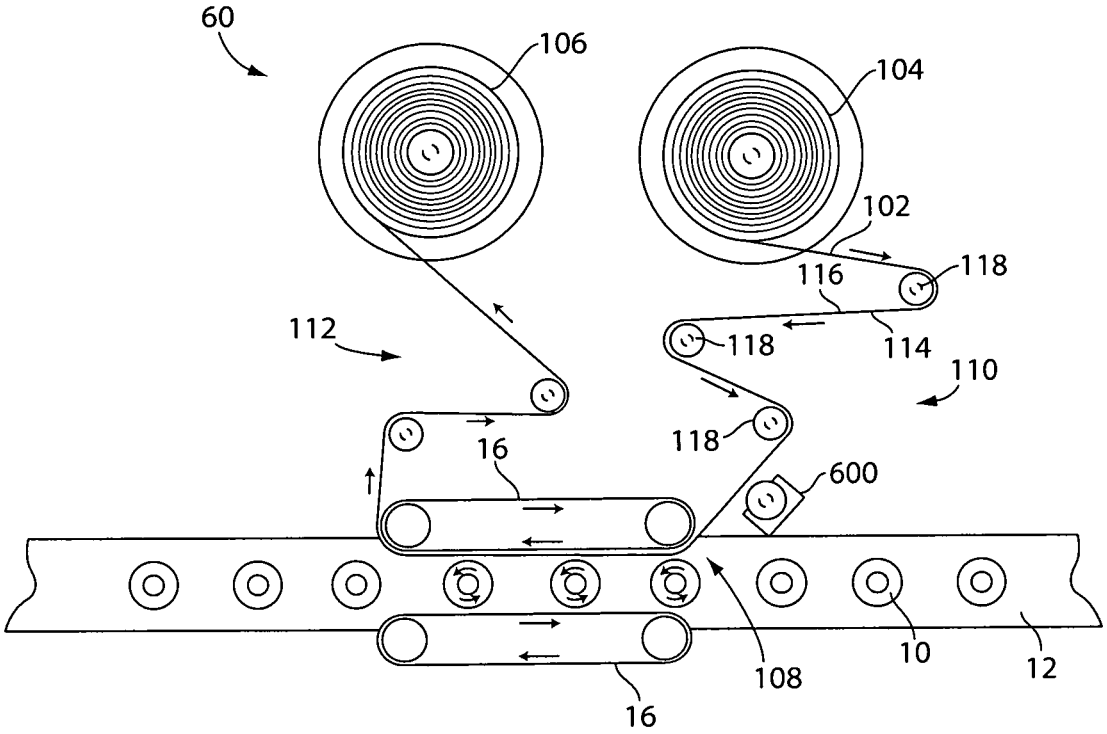
FIG. 9 is a top view of a label application system including an adhesive application station, according to one embodiment.

FIGS. 7-8 depict another illustrative embodiment of a label application system 58 in which labels 18 are spaced along the first side 114 of the web 102, and a web controller 500 is arranged to contact the portions of the first side of the web between the labels. As illustrated, the web controller includes two rollers 502 provided on an arm 504, which is rotatably mounted on a shaft 506. The arm 504 and shaft 506 may be mounted below the web, and the rollers 502 may extend upwardly to contact portions of the first side 114 of the web between labels 18. In particular, FIG. 7 depicts the web controller 500 in a first configuration in which both rollers 502 are in contact with the first side 114 of the web, and FIG. 8 depicts the web controller in a second configuration in which only one of the rollers 502 is in contact with the web. Accordingly, rotation of the web controller 500 causes the rollers to walk along the first side of the web and contact successive portions of the first side between the labels 18. Although a web controller with two rollers is depicted, it should be understood that other arrangements including more than two rollers are also contemplated. For instance, the web controller may include any number of rollers arranged to contact successive spaces between labels on the first side of the web. For example, the arm 504 may be arranged as a circular plate with multiple rollers 502 arranged at the periphery of the plate. Rotation of the plate may allow each roller 502 to contact a portion of the web 102 between labels 18 and move with the web 102. Additionally, although a configuration including rollers extending from below the web is depicted and described above, it should be understood that other configurations may be suitable. For instance, in one embodiment, the web controller may include a hub or drum with a plurality of protrusions extending radially outwardly from the hub (e.g., similar to a sprocket shape), and the protrusions may be arranged to contact the spaces between labels on the first side of the web.

As discussed previously, in some applications it may be desirable to avoid contact with an adhesive layer of a label prior to applying the label to a substrate. In one illustrative embodiment shown in FIG. 9, a label application system 60 includes an adhesive applicator 600 located along the first web path portion 110 adjacent the label application station. In this embodiment, the labels may be provided on the first side 114 of the web 102, but may not include an adhesive layer. Thus, the web may be controlled as desired along the first web path portion with web controllers 118 arranged to contact both the first and second sides 114, 116 of the web 102. Prior to label application at the label application station 108, the adhesive applicator 600 may apply an adhesive layer (e.g., a PSA or other suitable viscoelastic adhesive) to the labels. In some embodiments, the adhesive applicator 600 may be configured to print or otherwise apply the adhesive layer in registration with a pattern of the label provided on the web.

Figure 10:
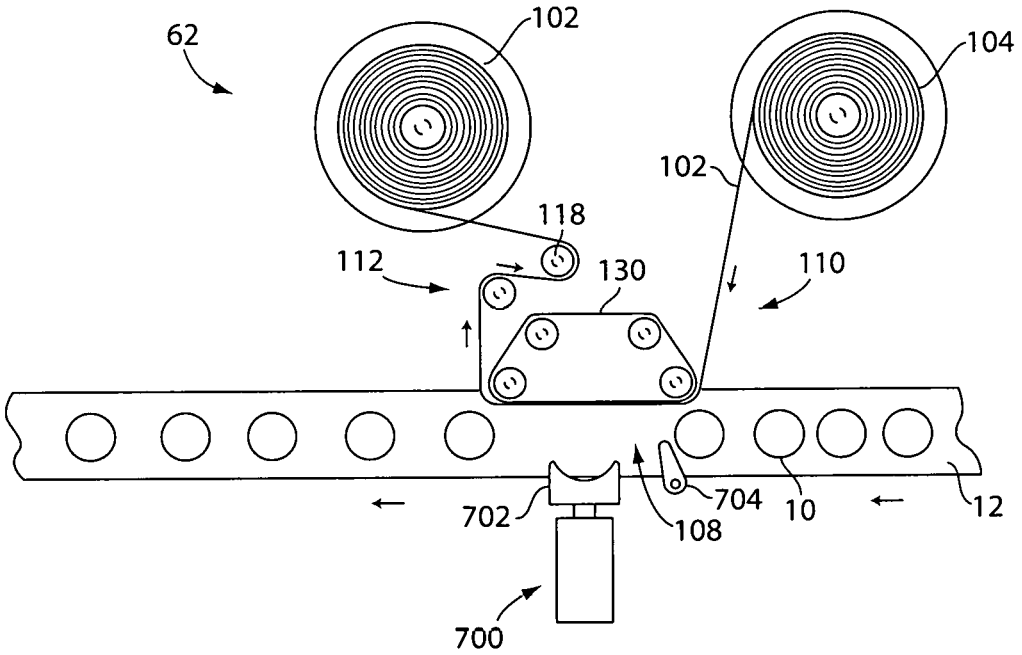
FIG. 10 is a top view of a label application system including an actuator to press a container against a web, according to one embodiment.
Figure 11:
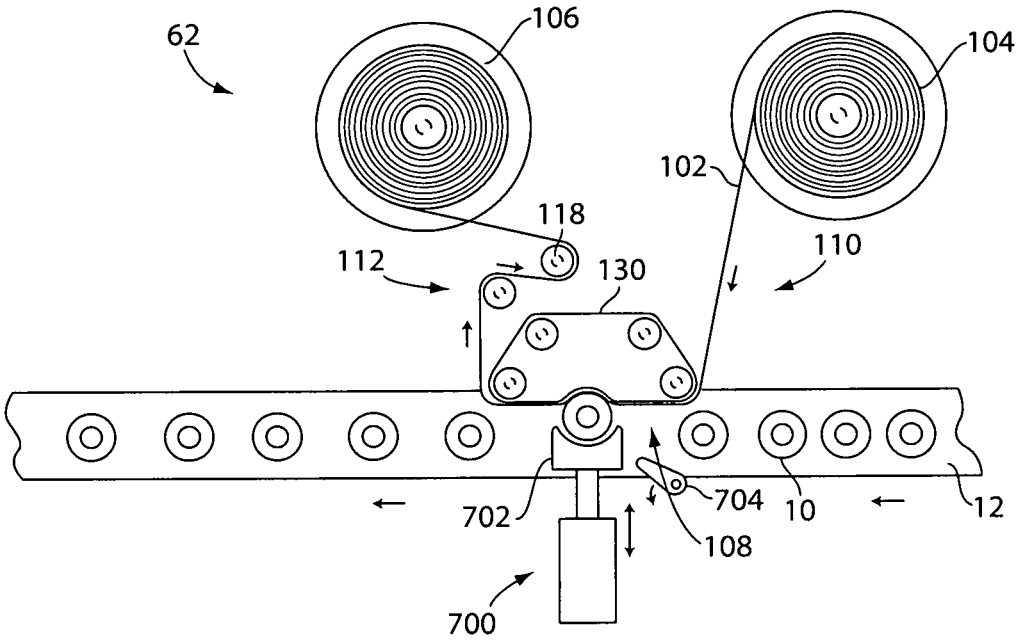
FIG. 11 shows the FIG. 10 embodiment with the actuator pressing the container against the web.

As noted above, in some label systems, an adhering force between the labels and the web may be similar in strength to an adhering force between the adhesive layer of the labels and the substrate when the label is applied to the substrate. Therefore, in some embodiments, a labeling system may include one or more features to provide an increased application force at a label application station, thereby enhancing the adhesion between the adhesive label and the substrate. For example, FIGS. 10-11 depict an illustrative embodiment of a labeling system 62 including an actuator 700 arranged to apply an enhanced application force between the bottles 10 and the labels provided on the web. In this embodiment, the actuator includes a bottle engaging member 702 located at the label applications station 108 and movable from a retracted position to an extended position. FIG. 10 depicts the bottle engaging member 702 in the retracted position, in which a bottle 10 may be transported along the belt 12 into a position in which the bottle engaging member may align with and engage the bottle. As illustrated in FIG. 11, when the bottler is engaged with the bottle engaging member, the actuator 700 is activated to move the bottle engaging member to the extended position and forcibly press the bottle into contact with a label provided on the web 102. In some embodiments, the web 102 may be supported by a flexible web support belt 130 while the web moves through the label application station 108, and the web support belt may deform as the actuator presses the bottle against the web. However, it should be understood that other web support arrangements are contemplated for supporting the web during label application, such as a compliant pad or a rigid support.

Figure 12:
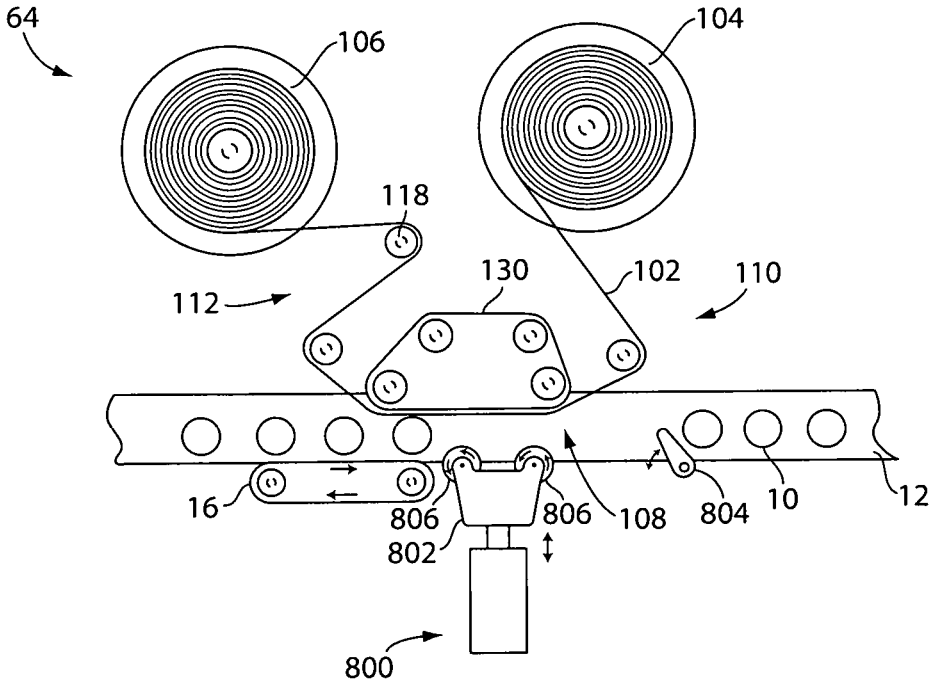
FIG. 12 is a top view of a label application system including an actuator to press a container against a web, according to one embodiment.
Figure 13:
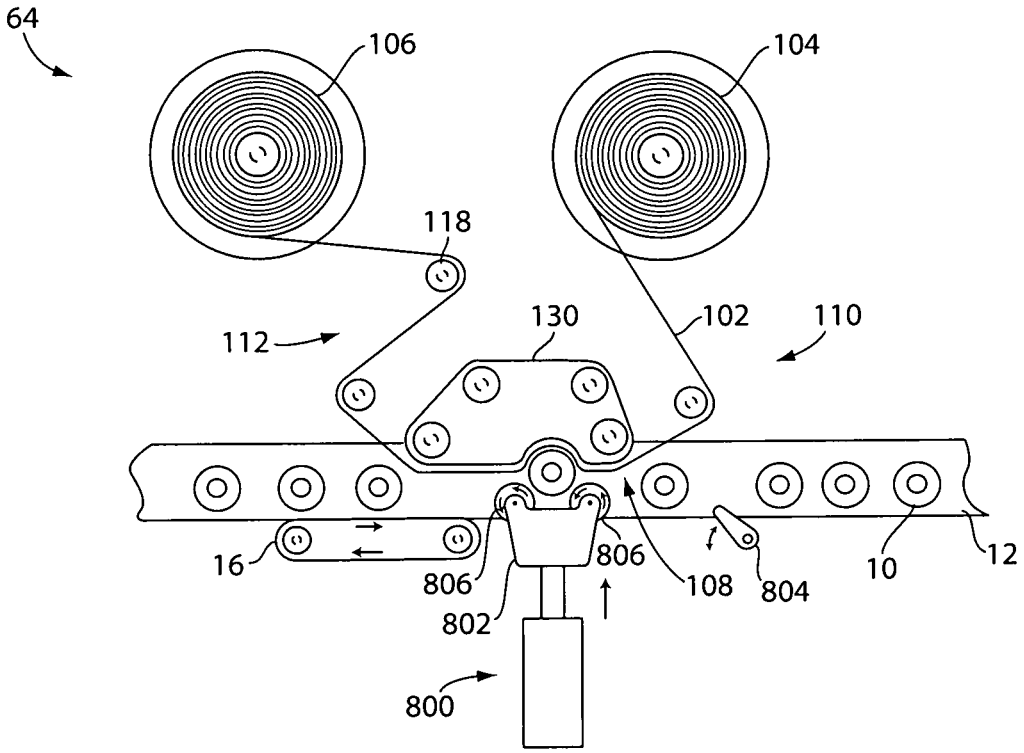
FIG. 13 shows the FIG. 12 embodiment with the actuator pressing the container against the web.

FIGS. 12-13 show another illustrative embodiment of a label application system 64 including an actuator 800 arranged to apply an enhanced application force between the bottles 10 and the labels provided on the web. In this embodiment, a label engaging member includes rollers 806 for contacting the bottle at the label application station.

Depending on the particular embodiment, a label application system including an actuator arranged to apply an enhanced application force may be configured to apply the application force to any suitable portion of the label. For instance, in the embodiment shown in FIGS. 10-11, the actuator 700 may be configured to apply an application force beginning generally at central portion of the label, e.g., along a midline of the label. In contrast, the actuator 800 shown in FIGS. 12-13 may be configured to apply an application force beginning at an edge of the label, e.g., to roll the label from the web 102 onto the bottle.

In some embodiments, a label application system may be arranged to actuate an actuator and apply a label from the web 102 onto the bottle while the web and/or belt 12 is continuously moving. Alternatively, in some applications, the web and/or belt may be operated intermittently to move a bottle 10 into the label application station 108, after which the web and/or belt may be paused while the actuator is activated to apply the label to the bottle. In some embodiments, a bottle timing cam (depicted as cam 704 in FIGS. 10-11 and cam 804 in FIGS. 12-13) may be provided on the belt 12 to selectively allow a bottle to move into the label application position. For instance, the belt 12 may be operated continuously, and the cams 704, 804 may selectively retain bottles from moving into the label application station, and subsequently allow one or more bottles to move into the label application station when desired.

Figure 14:
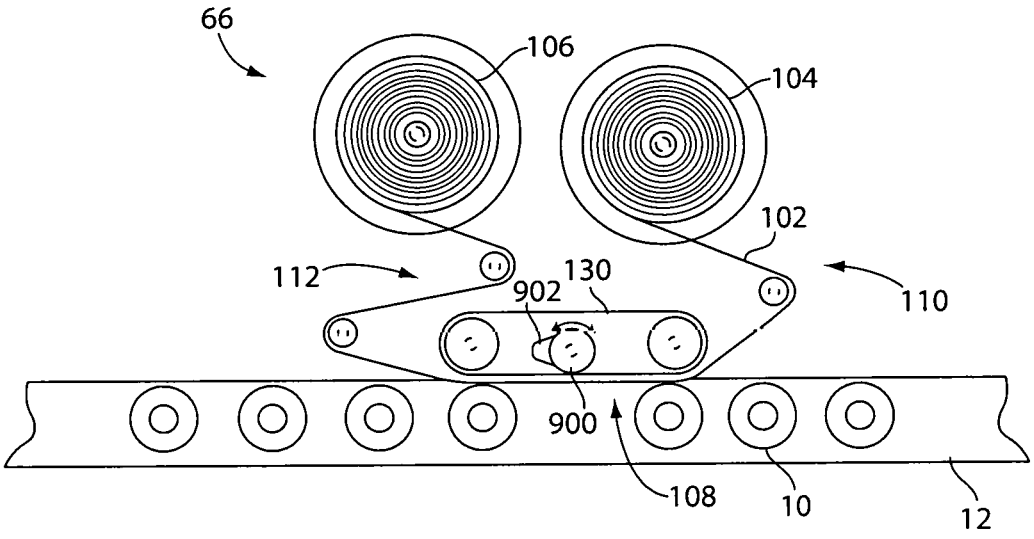
FIG. 14 is a top view of a label application system including an actuator to press a web against a container, according to one embodiment.
Figure 15:
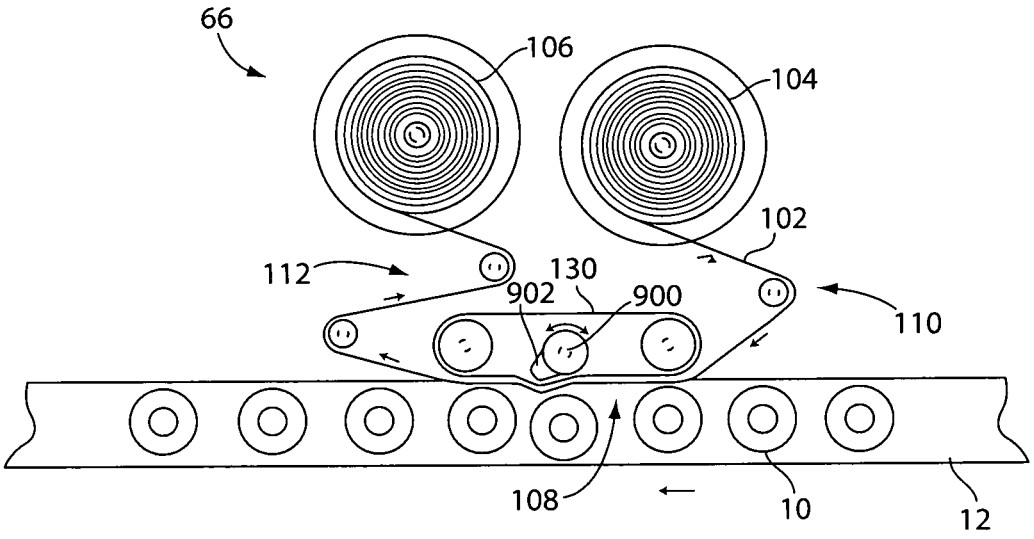
FIG. 15 shows the FIG. 14 embodiment with the actuator pressing the web against a container.
Figure 16:
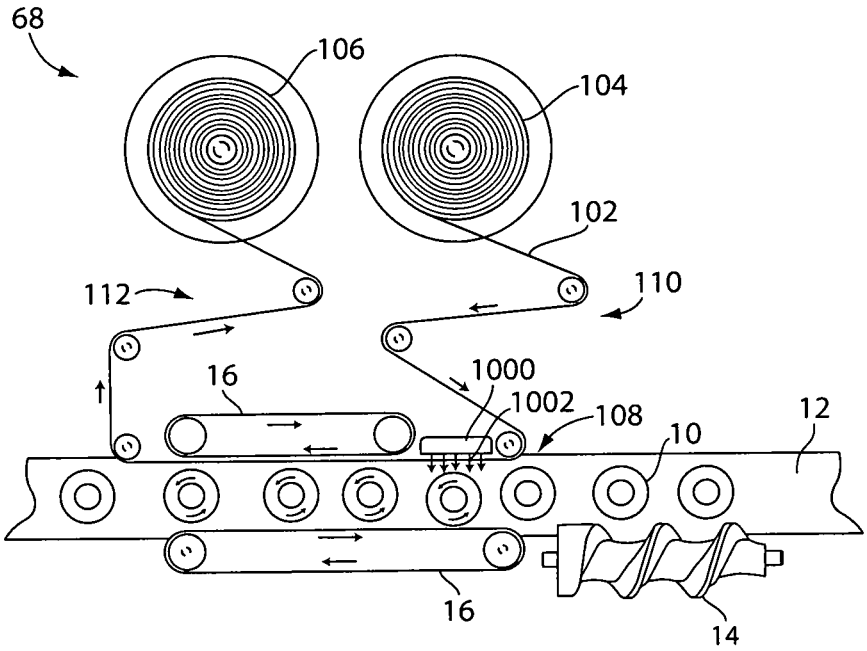
FIG. 16 is a top view of a label application system including a pressurized gas source for separating the labels form the web, according to one embodiment.

FIGS. 14-15 depict yet another illustrative embodiment of a label application system 66 including an actuator 900 provided at the label application station 108 to provide an enhanced label application force. In this embodiment, the actuator 900 is arranged to move a protrusion 902 into or out of engagement with the web support belt 130. In particular, FIG. 14 illustrates the actuator 900 in a first position in which the protrusion 902 is not engaged with the web support belt, such that a bottle 10 may be moved by the belt 12 into the label application station 108. When the bottle is in the desired position for label application, the actuator may cause the protrusion to rotate into engagement with the web support belt 130, thereby pressing the web support belt and the web 102 against the bottle to apply a label from the web onto the bottle (FIG. 15). In some embodiments, a bottle support (not depicted) may be provided on the other side of the bottles opposite the web support belt 130 to support the bottes during label application as the protrusion 902 presses the web against the bottle.

Figure 17:
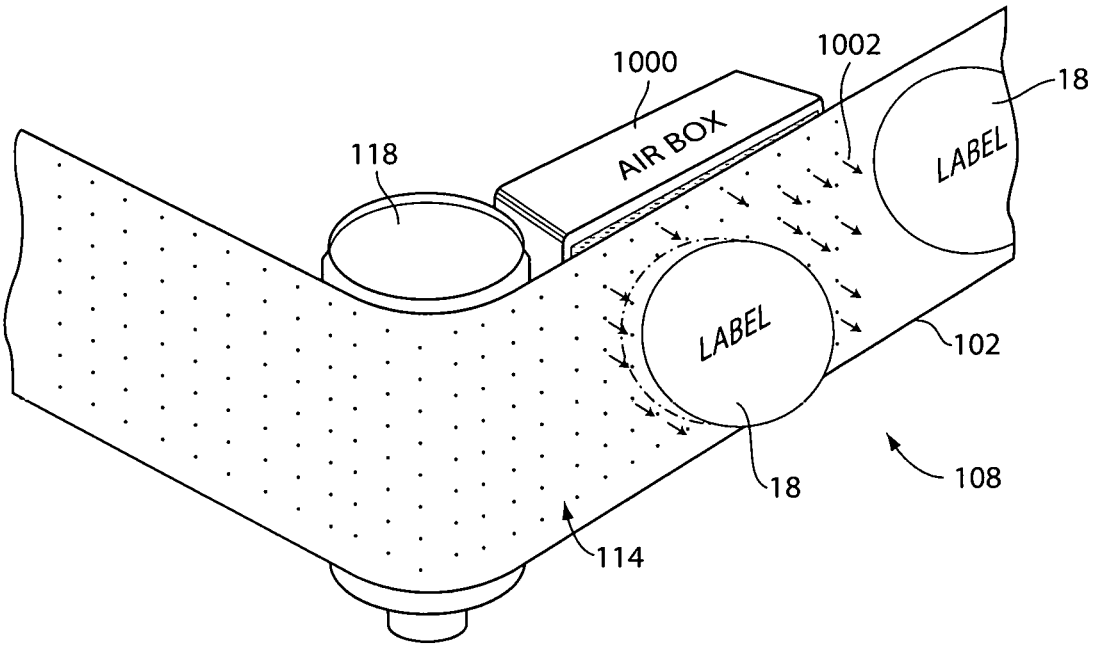
FIG. 17 is a front perspective view of a portion of the FIG. 16 embodiment.

As discussed previously, in some applications it may be desirable to assist with releasing the labels from the web at the label application station to ensure proper application of the label to the substrate. In one illustrative embodiment shown in FIGS. 16-17, the web 102 may be formed of a perforated or gas permeable material such that the web may allow a pressurized gas to flow through the web. An air box 1000 or other suitable pressurized gas source may be provided at the label application station 108 to provide an air flow 1002 (or a flow of another suitable gas) through the web. As illustrated in FIG. 17, the air flow may apply a force to the label 18 to assist with releasing the labels from the first side 114 of the web 102 prior to applying the label to a bottle. In some embodiments, the air flow 1002 may direct the label directly onto a bottle, and thus the airflow may assist with applying the label in addition to assisting with releasing the label from the web.

Figure 18:
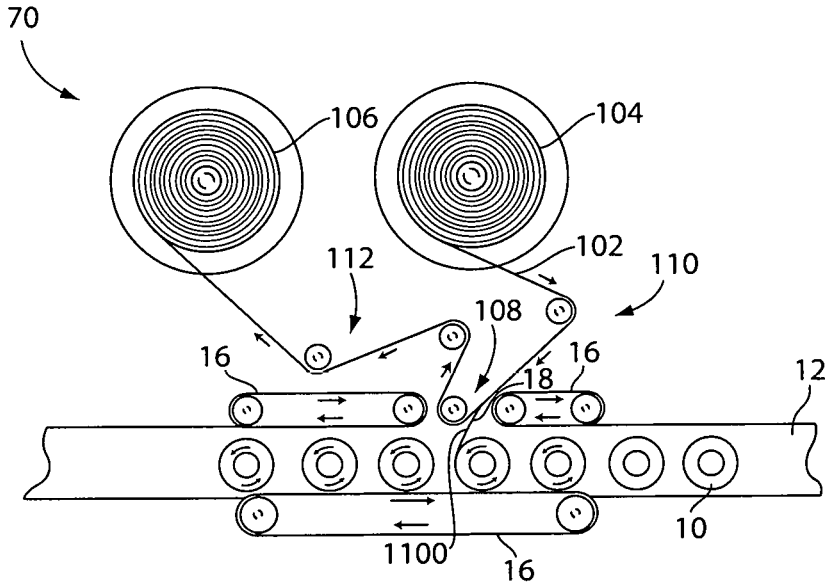
FIG. 18 is a top view of a label application system including a label separator, according to one embodiment.
Figure 19:
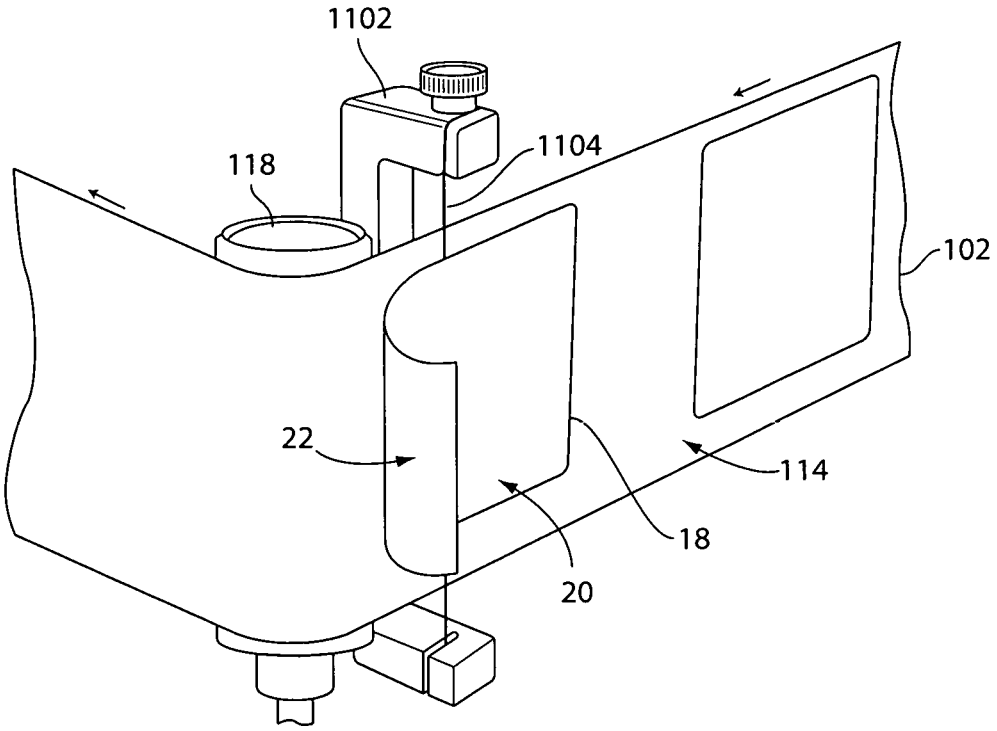
FIG. 19 is a front perspective view of a portion of the FIG. 18 embodiment.
Figure 20:
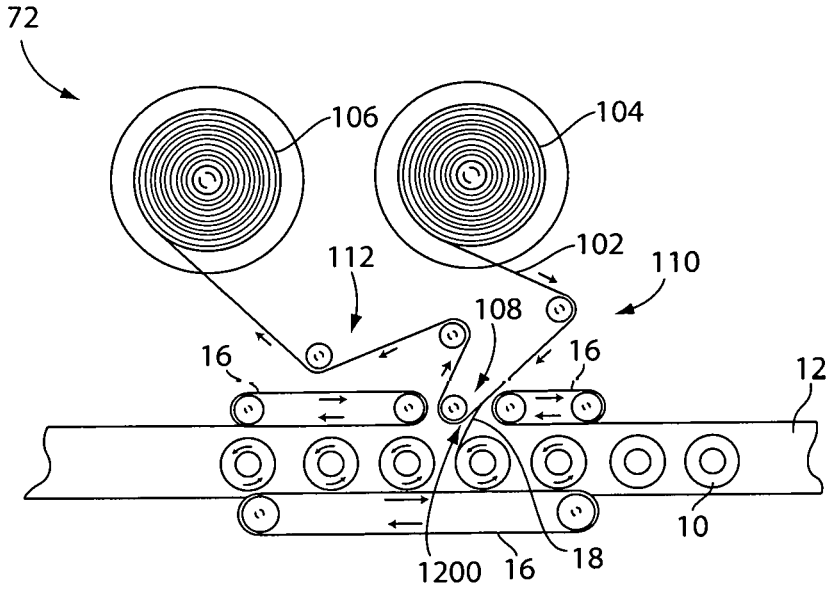
FIG. 20 is a top view of a label application system including a non-contact label separator according to one embodiment.
Figure 21:
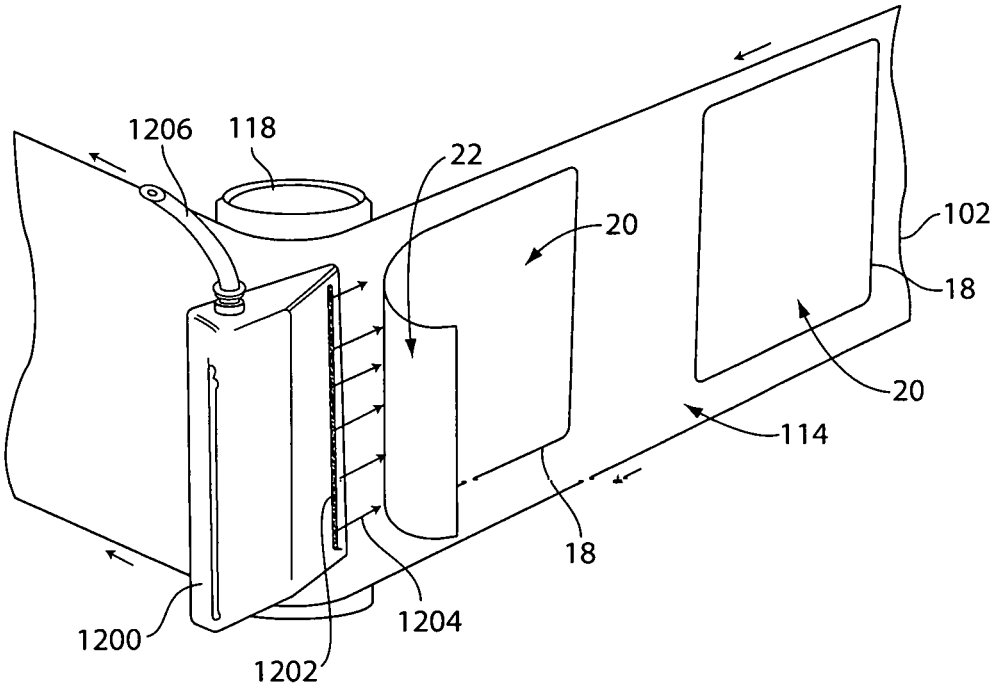
FIG. 21 is a front perspective view of a portion of the FIG. 20 embodiment.

FIGS. 18-19 show an illustrative embodiment of a label application system 70 including a label separator 1100 provided at the label application station to assist with releasing the labels 18 from the web 102. In this embodiment, the separator 1100 includes a wire 1104 mounted on a housing 1102. The wire is arranged to extend across the web 102 and apply a force (e.g., a peeling force) at an interface between the labels 18 and the front side 114 of the web. In this manner, the separator may assist with releasing a first side 22 of a label from the web such that the label may be more easily applied to a bottle 10 (or other suitable substrate) when the adhesive surface 20 of the label is brought into contact with the bottle. Although a wire is depicted in FIGS. 18-19, it should be understood that other separator structures may be suitable, such as a blade or razor arranged to apply a force to the interface of the label and the liner.

In some embodiments, a label separator may be arranged to facilitate separation of a label from a web without physically contacting the label or the web. For example, in one embodiment shown in FIGS. 20-21, a label application system 72 includes a label separator 1200 provided at the label application station 108. In this embodiment, the label separator 1200 may be an air blade arranged to direct a pressurized air flow 1204 (or flow of other suitable gas) towards the interface of the label 18 and the front side 114 of the web 102. The label separator 1200 may include an aperture 1202 coupled to an air supply 1206, and the aperture may be configured to shape the air flow 1204 to apply a desired force to release the label. Although the air flow 1204 is depicted as being applied in a direction generally along the first surface 114 of the web, it should be understood that other arrangements may be suitable. For instance, the label separator may be arranged to provide an air flow directed at an angle either toward or away from the web to provide a desired force at the label-web interface.

In some embodiments, a label application system may include one or more features to enhance the strength of the adhesive force between the adhesive layer on a label and the substrate relative to that between the label and the web. For example, in one illustrative embodiment shown in FIG. 22, a label application system 74 may include one or more activation stations 1300 arranged to activate a release layer provided at an interface between the labels and the web 102, thereby reducing the adhesive force holding the labels to the web. In some instances, activation of the release layer may completely release the label from the web and allow the label to be freely applied to the bottles 10 or other suitable substrates. In other embodiments, activation of the release layer may only partially release the label, but may decrease the adhesive force between the label and the web such that the label may be more easily pulled off of the web 102 when pressed against the bottle 10.

Figure 22:
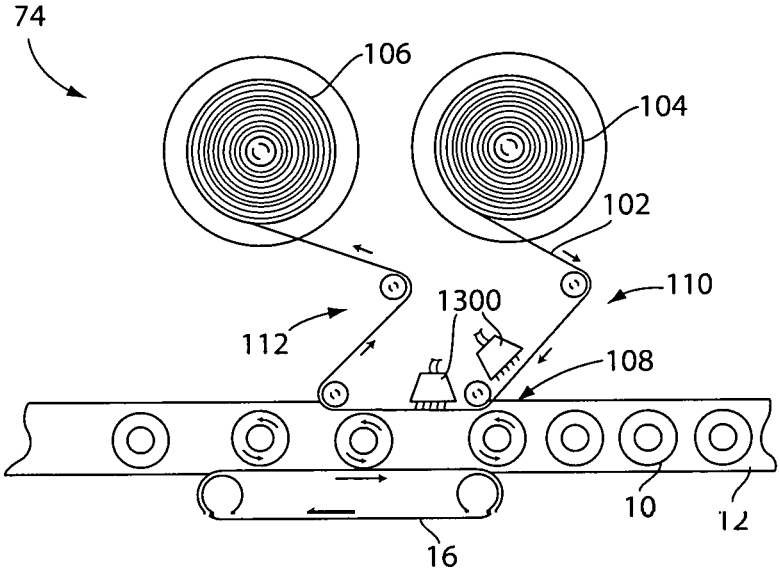
FIG. 22 is a top view of a label application system including an activation station for activating a release layer, according to one embodiment.

Depending on the embodiment, the release layer may be activatable by exposure to heat, radiation such as UV light, an activation fluid, etc. When activated, the release layer may melt, decompose, or otherwise change phase or form to aid in releasing the label from the web. As illustrated in FIG. 22, some systems may include more than one activation station 1300, and the activation stations may be located at the label application station 108 and/or along the first web path portion 110 for activation prior to application to the bottles 10.

Figure 23:
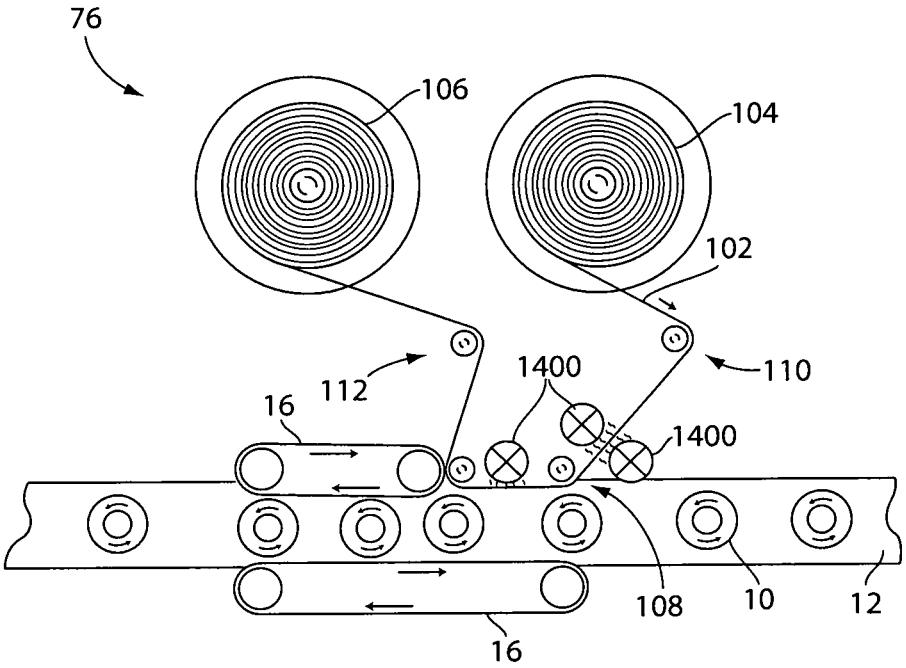
FIG. 23 is a top view of a label application system including an electrostatic charging station, according to one embodiment.

In another embodiment shown in FIG. 23, a label application system 76 may include one or more electrostatic charging stations 1400 arranged to apply an electrostatic charge on the labels provided on the web 102 and the bottles 10, prior to application of the labels to the bottles at the label application station 108. For example, the labels and the bottles may have opposite charges applied to their surfaces to create an electrostatic attractive force between the bottles and the labels. In some embodiments, the electrostatic attractive force may augment the adhesive force formed between the labels and the bottles during label application, thereby aiding in the release of the labels from the web 102 and/or proper application of the labels. In certain embodiments, such as those employing a separator to separate the labels from the web prior to application, the electrostatic attractive force created by the charging stations 1400 may be used to provide a provisional attachment between the labels and the bottles 10 until the labels are pressed against the bottles, e.g., with an actuator or other suitable arrangement provided at the label application station 108.

Figure 24:
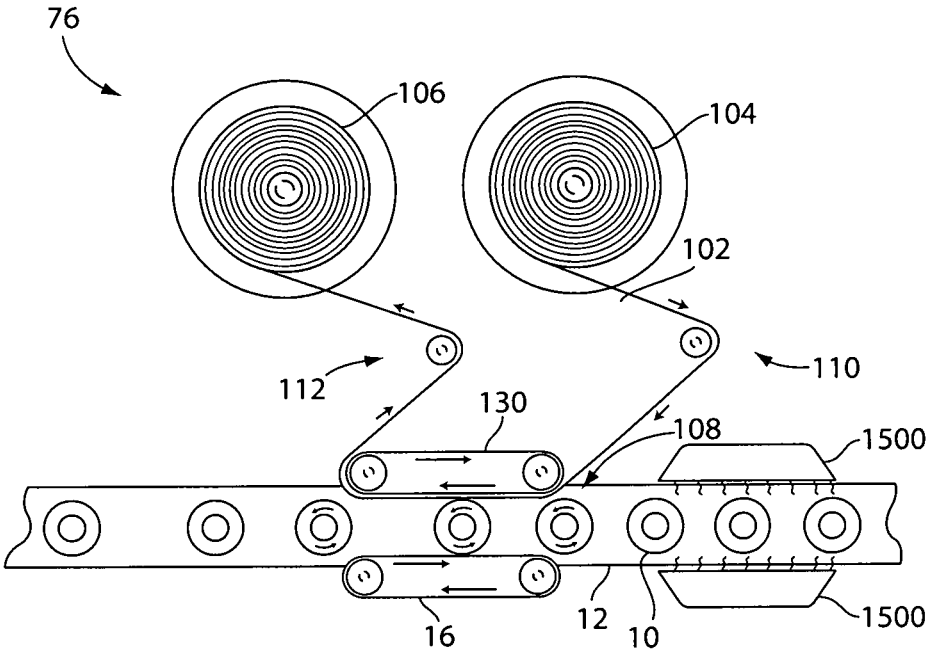
FIG. 24 is a top view of a label application system including a container treatment station, according to one embodiment.

In some embodiments, the bottles (or other suitable containers) may be treated prior to being transported to the label application to promote adhesion between the bottles and the labels. For example, FIG. 24 shows one embodiment of a label application system 78 including bottle treatment stations 1500 arranged to apply a treatment to the surface of the bottles prior to application of the labels at the label application station 108. In some embodiments, the bottle treatment may include, without limitation, a thermal treatment (e.g., the bottles may be passed through one or more heaters), exposure to radiation such as UV light, and/or application of a suitable fluid.

In some embodiments, the label application station 108 may be arranged to hold the web 102 in contact with the bottles 10 over an extended contact length. FIG. 24 illustrates one such embodiment in which the extended contact length corresponds to a length of the web support belt 130 along which the web travels. In some instances, the bottles (or other suitable substrates) may be supported along the contact length, e.g., with a suitable bottle support such as belt 16. As the bottles travel through the label application station 108, the labels are held in contact against the bottles 10 while the labels are still on the web 102. In this manner the adhesive layer on the labels may have adequate time to form an adhesive bond with the bottles, which, in some cases, may aid in releasing the labels from the web 102.

Figure 25:
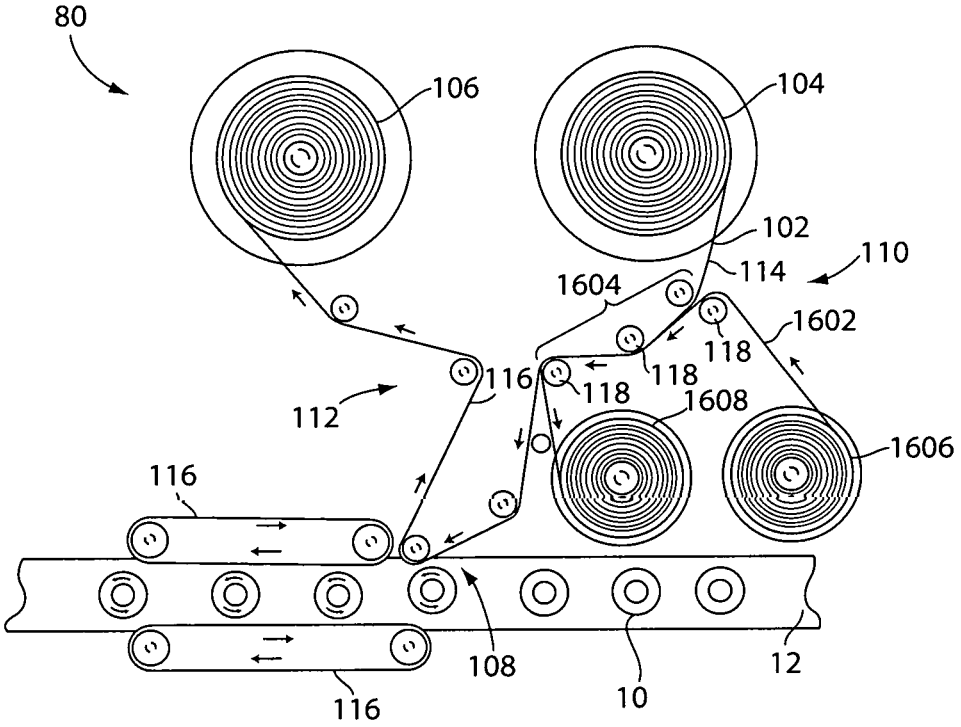
FIG. 25 is a top view of a label application system including a temporary liner, according to one embodiment.

As discussed previously, according to some aspects, a label application system may employ a temporary liner to protect the front side of the web (including the labels provided thereon) as the web is guided through at least a portion of the first web path portion prior to label application. For example, FIG. 25 shows an illustrative embodiment of a label application system 80 in which a liner 1602 is provided to contact the first side 114 of the web 102 along a contact length 1604 located along the first web path portion 110. The liner may protect first side 114 of the web 102, including an adhesive layer of the labels provided on the web, of as the web is guided through the contact portion is guided through the contact length. In this manner, the liner may allow for the use of one or more web controllers, such as the web controllers 118 described above, along the contact length of the first web path portion for controlling the web prior to label application. In this embodiment, the liner 1602 may a web similar to web 102, and may be transported on a liner path (including the contact length 1604) from a liner roll 1606 to a liner take-up reel 1608.

Figure 26:
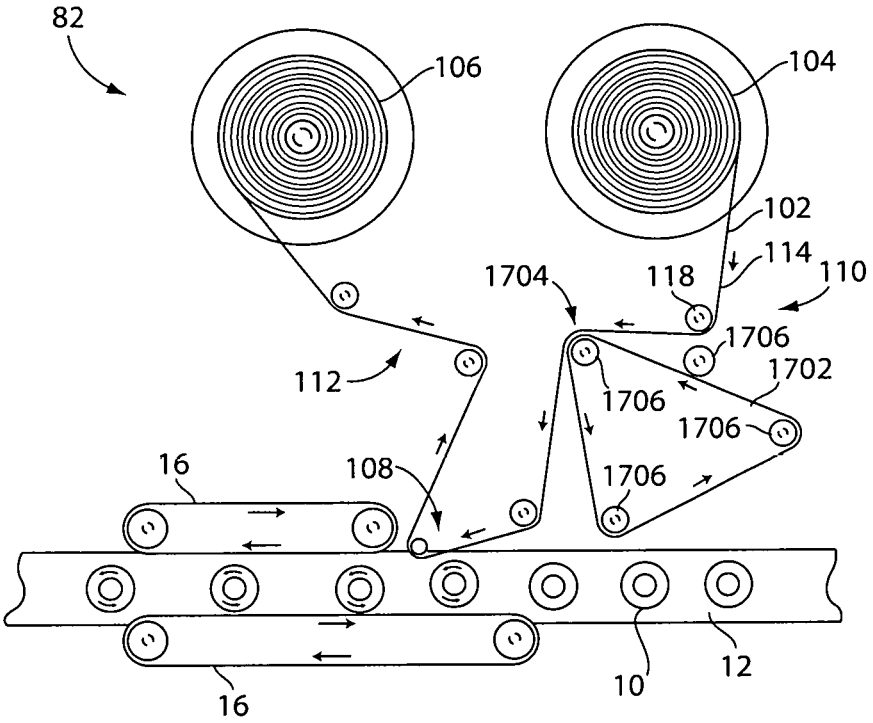
FIG. 26 is a top view of a label application system including a temporary liner loop, according to one embodiment.

In another illustrative embodiment shown in FIG. 26, a label application system 82 includes a liner 1702 provided as a continuous loop. The liner is guided continuously along a liner path including a contact length 1704 where the liner 1702 contacts a first side 114 of the web. Similar to the embodiment described above in connection with FIG. 25, the liner may protect the first side of the web along the contact length and allow one or more web controllers to be provided along the contact length to control the web 102 as desired prior to label application. As show in FIG. 26, one or more liner controllers 1706, such as rollers or other suitable features to drive and/or otherwise control the liner may be provided, and the liner controllers may be arranged in any suitable configuration. For example, in FIG. 26 the liner controllers are arranged to define a generally triangular liner path, though it should be understood that additional liner controllers may be provided to define other shapes, including non-triangular shapes, as desired. Moreover, as illustrated in FIG. 26, one or more liner controllers may be provided along the contact length 1704 and may be used as web controllers to control one or more characteristics of the web 102 along the first web path portion 110.

Figure 27:
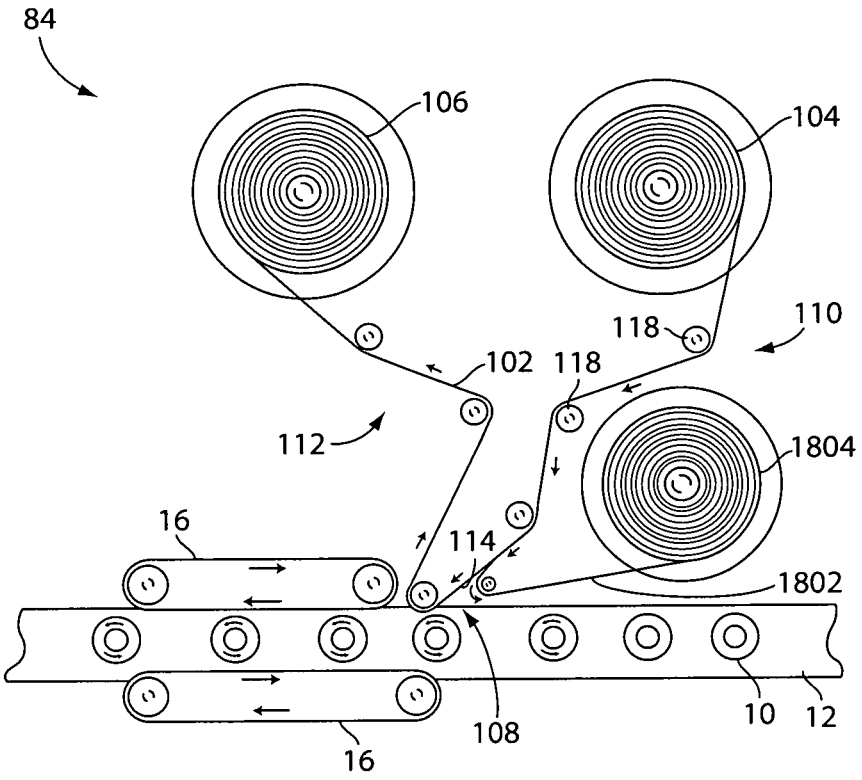
FIG. 27 is a top view of a label application system including a temporary liner, according to one embodiment.

In some embodiments, a liner may be provided to protect the first side 114 of the web 102 during the manufacturing process and prior to rolling the web into a web roll 104. For example, as illustrated in FIG. 27, the web roll 104 includes a web 102 have a liner 1802 provided thereon. When the web is unwound from the web roll 104 and guided through the first web path portion the liner may protect the first side 114 of the web, and allow one or more web controllers 118 to be provided along the first path portion to control one or more characteristics of the web, as desired. Prior to application of the labels at the label application station 108, the liner may be removed from the web 102 and wound onto a liner take-up roll 1804. In some instances, the liner 1802 may be reusable, such that the liner may be unwound from the take-up roll 1804 and applied to a new web during a subsequent manufacturing process.

Figure 28:
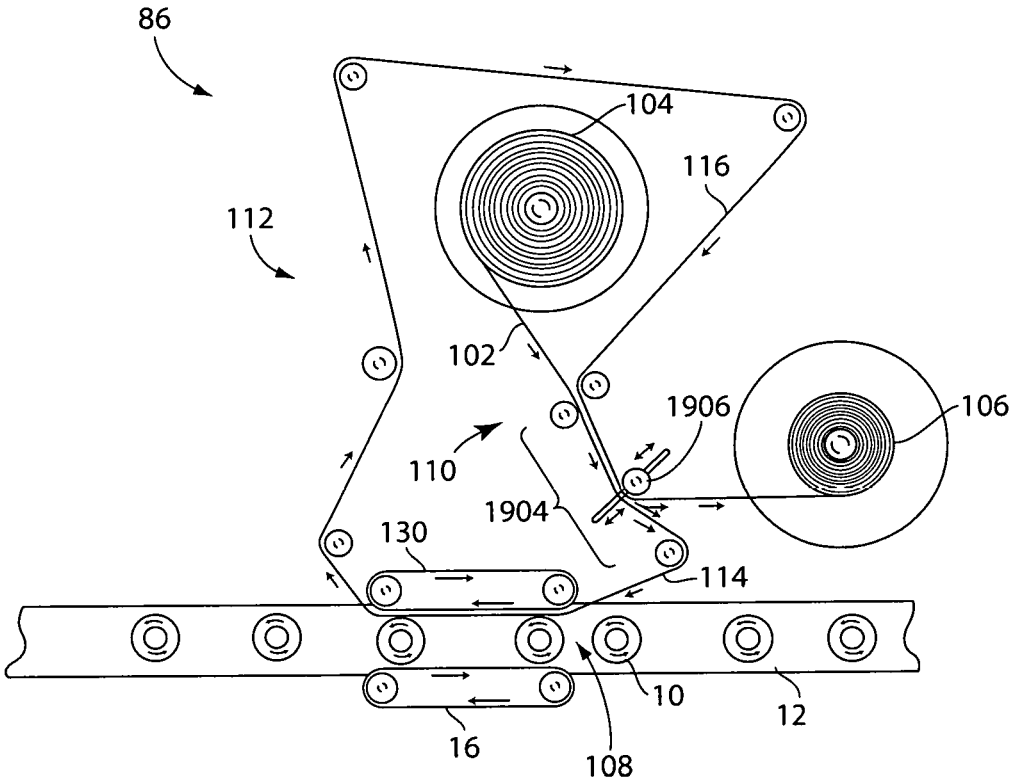
FIG. 28 is a top view of a label application system in which a portion of the web is used as a temporary liner, according to one embodiment.

In some embodiments, a separate liner may not be provided, and instead, a portion of the web in the second web path portion may be used as the liner to protect the first side of the web along the first path portion. For example, FIG. 28 depicts an illustrative embodiment in which the second web path portion 112 is arranged to guide the web such that the second side 116 of the web is brought into contact with the first side 114 of the web along a contact length 1904 in the first web path portion 110. In this manner, the web 102 in the second path portion 112 acts as the liner to protect the first side 114 of the web along the first web path portion 110, and allow for the web to be controlled as desired along the first web path portion. For instance, a liner controller 1906 may be provide along the contact length 1904, and the liner controller may be used to control one or more web characteristics along the first path portion 110. As illustrated, in some embodiments, the liner controller 1906 may be movable to adjust the web path along the first web path portion 110 and/or to adjust the tension or other characteristics of the web prior to application of the labels from the web. After the web 102 is guided through the second web path portion, including through the contact length 1904, the web may be guided to the web take-up roll 106.

Depending on the embodiment, a liner a may be configured to easily release from the first side of the web. For example the liner may include a surface which has a low adhesion strength to the adhesive layer of the labels such that the liner may contact the adhesive layer along a contact length, and subsequently easily be released from the adhesive layer without disturbing labels on the web.

Figure 29:
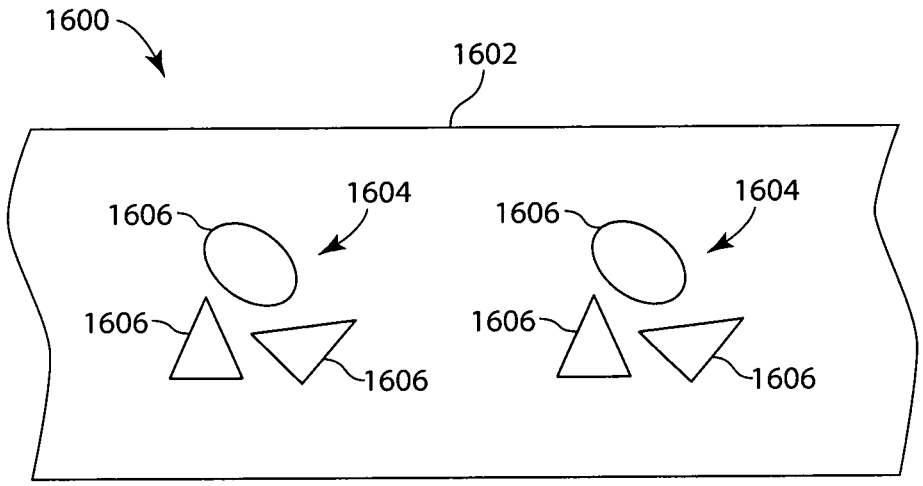
FIG. 29 is a schematic representation of a decoration including multiple separate decoration components, according to one embodiment.

As discussed above, in some instances, a decoration may include two or more physically separate components that together make up a single decoration. For example, FIG. 29 depicts a portion of a decoration transfer system 1600 including a continuous web 1602 on which a plurality of decorations 1604 are provided. Each decoration 1604 includes multiple separate decoration elements 1606. When the decoration 1604 is applied to a substrate, the decoration components 1606 are applied together in register with one another and work together to form a single decoration on the substrate. Depending on the particular embodiment, the decoration 1604 may include any suitable number of separate decoration components 1606, and each decoration component may have any suitable shape, orientation, color, pattern, and so on. For example each decoration component could be graphic design composed of two or more separate features. In other instances, each decoration may be a text string (e.g., a word, phrase or number), and the decoration components may include individual text characters that together form the text string. Moreover, combinations of different types of decoration components (e.g., graphical, text, or other types of decoration elements) may be included within a single decoration.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A system for applying decorations to substrates, comprising:

a continuous web including a plurality of decorations provided on a first side of the web, each decoration having an adhesive exposed on a surface of the decoration facing outwardly from the first side of the web;

an application station at which the decorations are applied from the web to substrates;

a web path along which the web travels to transport the decorations to the application station, wherein the web and the web path are arranged such that the web travels along the web path both to and away from the application station;

a web control system including at least one web controller, wherein the web control system is configured to stop movement of the web when a decoration is positioned at the application station; and a substrate transport configured to move a substrate through the application station while the web is stopped to move the substrate relative to the decoration positioned at the application station and apply the decoration to the substrate.

2. The system of claim 1, wherein the adhesive is a pressure sensitive adhesive.

3. The system of claim 1, the web control system is configured to move the web to transport a second decoration of the plurality of decorations to the application station after application of the decoration to the substrate.

4. The system of claim 1, wherein each decoration of the plurality of decorations comprises two or more physically separate decoration components, and the adhesive is exposed on a surface of each decoration component facing outwardly from the first side of the web.

5. The system of claim 4, wherein the two or more decoration components are applied in register with one another to the substrate at the application station.

6. The system of claim 1, wherein the decorations are transferred directly from the web to the substrate when applied to the substrates at the application station.

7. A method for applying a decoration to a substrate, comprising:

moving a continuous web along a web path to transport a plurality of decorations provided on a first side of the web to an application station, wherein each decoration has an adhesive exposed on a surface of the decoration facing outwardly from the first side of the web;

stopping movement of the web when a decoration is positioned at the application station;

moving a substrate through the application station while the web is stopped to apply the decoration positioned at the application station to the substrate from the web; and moving the web along the web path such that a portion of the web from which the decoration was applied to the substrate is moved away from the application station.

8. The method of claim 7, wherein the adhesive is a pressure sensitive adhesive.

9. The method of claim 7, further comprising moving the web after transferring the decoration to transport a second decoration of the plurality of decorations to the application station.

10. The method of claim 7, wherein each decoration of the plurality of decorations comprises two or more physically separate decoration components, and the adhesive is exposed on a surface of each decoration component facing outwardly from the first side of the web.

11. The method of claim 10, further comprising applying the two or more decoration components in register with one another to the substrate at the application station.

12. The method of claim 7, wherein the decoration is transferred directly from the web to the substrate when the decoration is applied to the substrate.

13. A system for applying decorations to a substrate, comprising:

an application station at which decorations are applied to substrates from a web, the web including a first side and a second side opposite the first side, the decorations provided on the first side and each having an adhesive exposed on a surface of the decoration facing outwardly from the first side of the web, wherein the web remains intact after the decorations are applied the substrates;

a web path along which the web travels to transport the decorations to the application station, the web path including a first path portion positioned before the application station to move the web to the application station and a second path portion positioned after the application station to move the web away from the application station; and a liner arranged to contact the first side of the web only along a contact length of the first web path portion, wherein the contact length is shorter than a length of the first web path portion.

14. The system of claim 13, further comprising a liner guide arranged to remove the liner from the first side of the web.

15. The system of claim 13, wherein the liner is transported from a first liner reel, through the contact length, to a second liner reel.

16. The system of claim 13, wherein the liner is provided as a continuous loop.

17. The system of claim 13, wherein the liner is a portion of the web along the second web path portion.

18. The system of claim 13, further comprising a web control system including at least one web controller arranged to apply a force to the first side of the web through the liner while the liner is in contact with first side.

19. A method for applying a decoration to a substrate, comprising:

transporting a decoration along a web path to an application station, wherein the decoration is provided on a first side of a web opposite a second side of the web and has an adhesive exposed on a surface of the decoration facing outwardly from the first side of the web, and the web path includes a first path portion positioned before the application station to move the web to the application station and a second path portion positioned after the application station to move the web away from the application station;

moving a liner into contact with the first side of the web only along a contact length of the first web path portion, wherein the contact length is shorter than a length of the first web path portion; and applying the decoration to a substrate at the application station, wherein the web remains intact after the decoration is applied to the substrate.

20. The method of claim 19, further comprising removing the liner from the first side of the web with a liner guide.

21. The method of claim 19, further comprising guiding the liner from a first liner reel, through the contact length, and to a second liner reel.

22. The method of claim 19, wherein the liner is a portion of the web along the second web path portion, and further comprising guiding the portion of the web to move the second side of the web into contact with the first side of the web along the contact length.

23. The method of claim 19, further comprising controlling at least one web characteristic by applying a force to the first side of the web through the liner along at least a portion of the contact length.

* * * * *